US009717322B1

(12) United States Patent
Bergquist

(10) Patent No.: US 9,717,322 B1
(45) **Date of Patent: *Aug. 1, 2017**

(54) CONVERTIBLE CARRYING CASE

(71) Applicant: Bart Brian Bergquist, Milwaukie, OR (US)

(72) Inventor: Bart Brian Bergquist, Milwaukie, OR (US)

( * ) Notice: Subject to any disclaimer, the term of this patent is extended or adjusted under 35 U.S.C. 154(b) by 341 days.

This patent is subject to a terminal disclaimer.

(21) Appl. No.: 14/454,557

(22) Filed: Aug. 7, 2014

Related U.S. Application Data

(63) Continuation of application No. 13/544,970, filed on Jul. 9, 2012, now Pat. No. 8,820,596.
(Continued)

(51) Int. Cl.
*A45F 3/02* (2006.01)
*A45F 4/00* (2006.01)
(Continued)

(52) U.S. Cl.
CPC ..... *A45F 4/00* (2013.01); *A45C 3/001* (2013.01); *A45C 3/004* (2013.01); *A45C 13/00* (2013.01);
(Continued)

(58) Field of Classification Search
CPC ..... A45F 3/04; A45F 3/02; A45F 3/00; A45C 3/004
(Continued)

(56) References Cited

U.S. PATENT DOCUMENTS 34,272 A 1/1862 Short
268,932 A 12/1882 Poirier
(Continued)

FOREIGN PATENT DOCUMENTS

FR 695048 A 12/1930
FR 759958 2/1934
(Continued)

OTHER PUBLICATIONS

Tumi, Inc., "Dror Brief", at least as early as Oct. 1, 2012, http://m.tumi.com/aHR0cDovL3d3dy50dW1pLmNvbS9wcm9kdWN0L2luZGV4LmpzcD9wcm9kdWN0SWQ9MTI1NTk1NDQmb3JkZXJTb3VyY2VDb2R1PTA%3D.

*Primary Examiner* — King M Chu
(74) *Attorney, Agent, or Firm* — Law Office of Karen Dana Oster, LLC

(57) ABSTRACT

A convertible carrying case having a first container and a second container that is convertible between a primary configuration and a secondary configuration. Each container having a primary face (with primary access structure for accessing the interior of the container when the convertible carrying case is in the primary configuration) and a secondary face (with secondary access structure for accessing the interior of the container when the convertible carrying case is in the secondary configuration). A first matable half and a second matable half of an openable-closeable connection are connectable to secure the containers in either a primary configuration or a secondary configuration. Preferably, contents within the containers may remain during conversion between the primary configuration and the secondary configuration. A method for converting a convertible carrying case between the primary configuration and the secondary configuration.

18 Claims, 32 Drawing Sheets

Related U.S. Application Data

(60) Provisional application No. 61/506,026, filed on Jul. 8, 2011.

(51) Int. Cl.
*A45C 3/00* (2006.01)
*A45C 13/00* (2006.01)

(52) U.S. Cl.
CPC ... *A45C 2003/005* (2013.01); *A45F 2004/003* (2013.01); *A45F 2004/006* (2013.01)

(58) Field of Classification Search
USPC ..... 224/575, 153, 576, 577, 581
See application file for complete search history.

(56) References Cited

U.S. PATENT DOCUMENTS 294,622 A 3/1884 Honinger
340,339 A * 4/1886 Marshall ..... A45F 3/04 224/42.11
385,429 A 7/1888 Sohner
417,301 A 12/1889 Weldon
424,324 A * 3/1890 Marshall ..... A45F 3/04 224/42.11
432,607 A 7/1890 Dwyer
447,669 A 3/1891 Dwyer
450,988 A 4/1891 Brown
504,101 A 8/1893 Zbinden
511,690 A 12/1893 Edwards
829,058 A 6/1906 Leavy
922,046 A 5/1909 Royce
922,567 A 5/1909 Cosgrove
954,825 A 4/1910 Schumacher
954,840 A 4/1910 Wiedemann
995,963 A 6/1911 Harriman
1,084,360 A 1/1914 Rahm
1,329,429 A 2/1920 Perry
1,370,636 A 3/1921 Dwyer
1,397,161 A 11/1921 Tobias
1,491,807 A 4/1924 Mclinn
1,510,815 A 10/1924 Adams
1,537,956 A 5/1925 Mcnally
1,606,107 A 11/1926 Simms
1,636,194 A 7/1927 Mullins
1,666,704 A 4/1928 Hunter
1,705,149 A 3/1929 Brady
1,761,426 A 6/1930 Chute
1,859,052 A 5/1932 Ritter
1,871,549 A 8/1932 Miller
1,914,087 A 6/1933 Gilmore
1,920,308 A 8/1933 Hiles
2,005,791 A 6/1935 Gustave
2,010,166 A 8/1935 Thompson
2,023,792 A 12/1935 Sampson
2,063,850 A 12/1936 Nemeth et al.
2,078,624 A 4/1937 Wolff et al.
2,086,326 A 7/1937 Goldberg
2,086,895 A 7/1937 Cart
2,087,210 A 7/1937 Marbury et al.
2,105,319 A 1/1938 Hedden et al.
2,143,062 A 1/1939 Ericson et al.
2,154,630 A 4/1939 Marbury et al.
2,164,641 A 7/1939 Davenport
2,182,879 A 12/1939 Rinehart
2,254,578 A 9/1941 O'Brien
2,270,049 A 1/1942 Greenstein
2,298,754 A 10/1942 Davis
2,362,807 A 11/1944 Dresner
2,370,492 A 2/1945 Russell
2,390,673 A 12/1945 Wallace
2,421,244 A 5/1947 Daiber
2,428,795 A 10/1947 Frazee
2,453,663 A 11/1948 Hinson
2,493,506 A 1/1950 Schwartzbard
D157,266 S 2/1950 Kiernan
2,527,059 A 10/1950 Di Mezza
2,540,165 A 2/1951 Fiel
2,551,929 A 5/1951 Collins
2,557,280 A 6/1951 Hans Hahn
2,611,519 A 9/1952 Utterstrom
2,612,199 A 9/1952 Schocket
2,674,288 A 4/1954 Laidlaw
2,797,779 A 7/1957 Davis
2,813,602 A 11/1957 MacArthur
2,836,334 A 5/1958 Davis
2,854,775 A 10/1958 Kleckley
2,887,196 A 5/1959 Davis
2,943,775 A 7/1960 Mack
2,979,098 A 4/1961 Greaves
3,019,869 A 2/1962 Engelhardt
3,019,952 A 2/1962 Brewster
3,033,431 A 5/1962 Henderson et al.
3,052,895 A 9/1962 Lo Vico
3,061,057 A 10/1962 Miller
3,114,486 A 12/1963 Flexman
3,122,225 A 2/1964 Ward
3,139,164 A 6/1964 Koffler
RE25,826 E 8/1965 Ward
3,233,803 A 2/1966 Gray
3,254,816 A 6/1966 Gray
3,292,747 A 12/1966 Dawson
3,335,775 A 8/1967 Adams
3,346,155 A 10/1967 Oechsle
3,363,814 A 1/1968 Hall et al.
3,409,192 A 11/1968 Scott
3,443,671 A 5/1969 Dyke
3,454,068 A 7/1969 Goldstein et al.
3,530,919 A 9/1970 May
3,530,961 A 9/1970 Weissenbach
3,542,170 A 11/1970 Bialo
3,543,825 A 12/1970 Dobbs
3,549,064 A 12/1970 Wilson
3,575,327 A 4/1971 Harrison
3,587,795 A 6/1971 Berry et al.
3,622,056 A 11/1971 Droeger
3,696,850 A 10/1972 Rosenblum
D227,044 S 5/1973 Camp
3,762,345 A 10/1973 Sgariglia
3,786,972 A 1/1974 Alley
D230,327 S 2/1974 Cooperstein
3,802,613 A 4/1974 Droeger
3,830,348 A 8/1974 Ohyama
3,837,447 A 9/1974 Honan
3,902,640 A 9/1975 Geiben
D237,752 S 11/1975 Bauer
3,933,229 A 1/1976 Pelavin
D238,725 S 2/1976 Zerobuick
3,937,374 A 2/1976 Hine, Jr.
3,938,716 A 2/1976 Jackson et al.
3,938,718 A 2/1976 Madison
3,957,184 A 5/1976 Shurman
3,960,300 A 6/1976 Dickler
3,963,102 A 6/1976 Carp
3,970,229 A 7/1976 Norinsky
3,989,174 A * 11/1976 Norinsky ..... A45C 3/00 190/902
3,994,372 A 11/1976 Geller et al.
3,995,802 A 12/1976 Johnston
4,018,369 A 4/1977 Jaeger
4,040,548 A 8/1977 Guglielmo
4,059,207 A 11/1977 Jackson et al.
4,066,195 A 1/1978 Dickler
D247,460 S 3/1978 Sykes
4,117,874 A 10/1978 Berenguer
4,153,146 A 5/1979 Patton et al.
4,182,391 A 1/1980 Kjose
4,194,602 A 3/1980 Allen
4,236,657 A 12/1980 Brunton
4,273,274 A 6/1981 Freistadt
4,334,601 A 6/1982 Davis
D270,586 S 9/1983 Tatnall et al.
4,442,960 A * 4/1984 Vetter ..... B62J 9/00 190/108

(56) References Cited

U.S. PATENT DOCUMENTS 4,449,655 A 5/1984 Germe
D275,622 S 9/1984 Pierce et al.
4,483,469 A 11/1984 Arisland
4,491,258 A 1/1985 Jones
4,506,769 A 3/1985 Franco et al.
4,513,866 A 4/1985 Thomas
D278,949 S 5/1985 Soininen
4,515,300 A 5/1985 Cohen
4,515,493 A 5/1985 Radovich
D279,144 S 6/1985 Allen
4,546,863 A 10/1985 Kaufman
4,561,576 A 12/1985 Lowe et al.
4,593,841 A 6/1986 Lange
4,609,084 A 9/1986 Thomas
4,662,551 A 5/1987 Dudley et al.
4,756,394 A 7/1988 Cohen
4,767,039 A 8/1988 Jacober
4,782,874 A 11/1988 Chartier
4,810,102 A 3/1989 Norton
4,830,245 A 5/1989 Arakaki
D302,211 S 7/1989 Sears
4,856,570 A 8/1989 Rushing et al.
4,869,408 A 9/1989 Lutz
4,874,340 A 10/1989 Smallwood
4,883,207 A 11/1989 McArthur
4,887,751 A 12/1989 Lehman
4,901,897 A * 2/1990 Briggs ..... A45C 3/004 206/287.1
4,925,070 A 5/1990 Tulgan
4,946,292 A 8/1990 Diamond et al.
4,951,816 A 8/1990 Smith
4,961,522 A 10/1990 Weber
4,979,658 A 12/1990 Baker
5,022,574 A 6/1991 Cesari
5,031,733 A 7/1991 Chang
D319,144 S 8/1991 Goude
D323,237 S 1/1992 Zoltie
D323,426 S 1/1992 Mahvi et al.
5,150,824 A 9/1992 Alvarez et al.
5,165,111 A 11/1992 Lieberman
5,215,318 A 6/1993 Capraro
5,222,642 A 6/1993 Solarz
D339,283 S 9/1993 Barros
D343,513 S 1/1994 DiTizio
5,361,951 A 11/1994 Chehebar
D354,849 S 1/1995 Herman et al.
5,377,887 A 1/1995 Garcia
5,400,903 A 3/1995 Cooley
D358,483 S 5/1995 Cross et al.
5,415,332 A 5/1995 Kliot
5,425,449 A 6/1995 Boorady
D359,847 S 7/1995 Callegari
D360,182 S 7/1995 Lovett
5,431,317 A 7/1995 Kliot
5,447,261 A 9/1995 Mitomi et al.
5,456,353 A 10/1995 Challoner et al.
5,490,619 A 2/1996 Boyar
5,544,792 A * 8/1996 Arnwine ..... A45C 7/0086 224/153
5,603,573 A 2/1997 Mercier et al.
5,647,522 A 7/1997 Routh
D387,198 S 12/1997 Lehmann et al.
5,692,660 A 12/1997 Stewart
5,706,992 A 1/1998 Moor
5,732,867 A 3/1998 Perkins et al.
5,749,503 A 5/1998 Wulf et al.
5,765,733 A 6/1998 Brule
5,797,529 A 8/1998 Lavine
5,799,851 A 9/1998 Wulf et al.
5,810,223 A 9/1998 Helm
5,819,998 A 10/1998 Chehebar
5,826,770 A 10/1998 Chuang
5,881,932 A * 3/1999 Wadden ..... A45F 3/04 150/108
5,887,770 A 3/1999 Covell
5,887,777 A 3/1999 Myles et al.
5,908,147 A 6/1999 Chuang
5,927,581 A 7/1999 Reddy et al.
D412,787 S 8/1999 Young
5,964,384 A 10/1999 Young
D420,792 S 2/2000 Sakelliou et al.
6,029,723 A 2/2000 Baquero et al.
D425,474 S 5/2000 Bergh
6,112,959 A 9/2000 Townsend
6,129,254 A 10/2000 Yu
6,134,712 A 10/2000 Spector
6,152,338 A 11/2000 Smith
D435,343 S 12/2000 Eskandry
6,161,738 A 12/2000 Norris
6,164,509 A 12/2000 Gausling et al.
6,174,082 B1 1/2001 Pelky et al.
6,179,175 B1 1/2001 Painter
6,193,118 B1 2/2001 Kearl
D441,190 S 5/2001 Eskandry
6,230,771 B1 5/2001 Hellenbrand
D446,009 S 8/2001 Mandell
6,305,587 B1 10/2001 Miller
6,336,577 B1 1/2002 Harris et al.
6,394,328 B1 5/2002 Zakarin
6,530,507 B2 3/2003 Oh
D472,371 S 4/2003 Pomare
6,592,012 B2 7/2003 Godshaw et al.
6,595,334 B1 7/2003 Saetia
6,601,743 B2 8/2003 Godshaw
D482,865 S 12/2003 Fair
6,655,565 B2 12/2003 Godshaw et al.
D485,432 S 1/2004 Desrochers
D498,585 S 11/2004 Darling
D511,620 S 11/2005 Van Himbeeck
6,968,880 B2 11/2005 Battaglia et al.
6,994,193 B2 2/2006 Saetia
D518,956 S 4/2006 Van Himbeeck
7,086,437 B1 8/2006 Michael
D529,717 S 10/2006 Brancky
7,191,925 B2 * 3/2007 Aris ..... A45C 9/00 224/581
D544,708 S 6/2007 Barker
D545,056 S 6/2007 Leighton
7,395,930 B2 7/2008 Tauchen
7,575,376 B2 * 8/2009 Yu ..... A45C 7/0077 190/103
7,593,222 B2 9/2009 Zbikowski
D605,849 S 12/2009 Mori
D610,797 S 3/2010 Shor et al.
7,681,769 B2 3/2010 Kramer
D623,857 S 9/2010 Austin
D625,518 S 10/2010 Edwards
D634,929 S 3/2011 Bizzell
D638,623 S 5/2011 Chen
D647,302 S 10/2011 Hoang
8,028,879 B2 10/2011 Amishay
8,123,090 B2 2/2012 Missick
8,146,787 B2 4/2012 Cragg
D658,363 S 5/2012 Biddle
D660,585 S 5/2012 McDonald et al.
D661,085 S 6/2012 Custer
D674,183 S 1/2013 Iacchetti
8,820,596 B1 * 9/2014 Bergquist ..... A45F 4/02 224/153
2002/0040493 A1 4/2002 Wooley et al.
2002/0113102 A1 8/2002 Klamm
2002/0145018 A1 10/2002 Godshaw et al.
2002/0162718 A1 11/2002 Wu
2003/0006258 A1 1/2003 Flynn
2003/0015559 A1 1/2003 Oh
2003/0042277 A1 3/2003 Gulmatico
2003/0057239 A1 3/2003 Godshaw
2003/0124948 A1 7/2003 Ostolaza
2003/0205593 A1 11/2003 Lavelle
2004/0065708 A1 4/2004 Amram
2004/0089683 A1 * 5/2004 Theodore ..... A45C 13/02 224/153
2004/0094583 A1 5/2004 Bernbaum et al.
2004/0163913 A1 8/2004 Tschudy

(56) References Cited

U.S. PATENT DOCUMENTS

| | | | | |
|---|---|---|---|---|
| 2004/0206791 | A1 | 10/2004 | Rogers | |
| 2005/0000993 | A1 | 1/2005 | Moskun | |
| 2005/0023309 | A1 | 2/2005 | Haugland | |
| 2005/0056668 | A1* | 3/2005 | Aris | A45C 9/00 224/153 |
| 2005/0056669 | A1 | 3/2005 | Lavelle | |
| 2005/0072642 | A1 | 4/2005 | Sanchez | |
| 2005/0090179 | A1 | 4/2005 | Carruth | |
| 2005/0092802 | A1 | 5/2005 | Maley | |
| 2005/0103817 | A1* | 5/2005 | Glankler | A45C 7/0086 224/583 |
| 2005/0173034 | A1 | 8/2005 | Antrobus | |
| 2005/0194413 | A1* | 9/2005 | Baker | A45C 3/14 224/153 |
| 2005/0258294 | A1 | 11/2005 | Dickson | |
| 2006/0105137 | A1 | 5/2006 | Kouts | |
| 2006/0119057 | A1 | 6/2006 | Russo | |
| 2006/0180624 | A1* | 8/2006 | Sadow | A45C 7/009 224/582 |
| 2007/0102460 | A1* | 5/2007 | Lottman | A45C 1/06 224/153 |
| 2007/0125815 | A1 | 6/2007 | Tong | |
| 2007/0199966 | A1 | 8/2007 | Korchmar | |
| 2008/0011567 | A1 | 1/2008 | Hammond | |
| 2008/0054031 | A1 | 3/2008 | Headley | |
| 2008/0116026 | A1 | 5/2008 | Bass et al. | |
| 2009/0071783 | A1 | 3/2009 | Nykoluk | |
| 2009/0127299 | A1 | 5/2009 | Jamlang | |
| 2009/0127307 | A1 | 5/2009 | Austwick et al. | |
| 2009/0173763 | A1 | 7/2009 | Bridgeman | |
| 2009/0184543 | A1 | 7/2009 | Blanarik | |
| 2009/0201671 | A1 | 8/2009 | Huntley | |
| 2010/0006613 | A1 | 1/2010 | Burns | |
| 2010/0072235 | A1 | 3/2010 | Barton et al. | |
| 2010/0108726 | A1 | 5/2010 | Hilgenberg | |
| 2010/0111448 | A1 | 5/2010 | Li | |
| 2010/0127024 | A1 | 5/2010 | Cortes | |
| 2010/0127025 | A1 | 5/2010 | Kelling | |
| 2010/0147918 | A1* | 6/2010 | Hensley | B62J 9/001 224/600 |
| 2010/0200632 | A1 | 8/2010 | Lee | |
| 2010/0205718 | A1 | 8/2010 | Eastep | |
| 2010/0219221 | A1 | 9/2010 | Zheng | |
| 2010/0243692 | A1 | 9/2010 | Sabbah | |
| 2010/0282809 | A1 | 11/2010 | Scicluna | |
| 2010/0284631 | A1 | 11/2010 | Lee | |
| 2010/0320248 | A1 | 12/2010 | Uimonen | |
| 2012/0018477 | A1 | 1/2012 | Inouye | |
| 2012/0111912 | A1 | 5/2012 | Zheng | |
| 2012/0240521 | A1 | 9/2012 | Johnson | |

FOREIGN PATENT DOCUMENTS

| | | |
|---|---|---|
| FR | 983806 | 6/1951 |
| FR | 1102369 | 10/1955 |
| GB | 188146 | 9/1921 |
| GB | 424204 | 2/1935 |
| GB | 1099200 | 1/1968 |

* cited by examiner

CONVERTIBLE CARRYING CASE

The present application is a continuation of U.S. patent application Ser. No. 13/544,970 filed Jul. 9, 2012, now U.S. Pat. No. 8,820,596. U.S. patent application Ser. No. 13/544,970 is an application claiming the benefit of U.S. Provisional Patent Application No. 61/506,026, filed Jul. 8, 2011. The present application is based on and claims priority from these applications, the disclosures of which are hereby expressly incorporated herein by reference.

BACKGROUND OF THE INVENTION

Disclosed herein is a convertible carrying case, and more specifically a convertible case that can be converted from a first configuration (emulating a first type of carrying case) to a second configuration (emulating a second type of carrying case).

"Carrying cases" are devices for transporting objects. Carrying cases generally include a plurality of panels or faces that are associated in such a way so as to provide an interior and also to selectively allow access to the interior (e.g. through an opening or access structure that may be selectively opened and closed). Objects may be inserted through the opening into the interior of the carrying case. Carrying cases generally include carry structures such as handles, straps, grips, and pulls. Exemplary types of carrying cases include, but are not limited to, backpacks, briefcases, purses, handbags, totes, satchels, camera bags, duffle bags, shoulder bags, clothes bags, garment bags, artist easels, makeup bags, computer bags, messenger bags, diaper bags, fishing bags, tack bags, saddle bags, luggage, suitcases, travel bags, panniers, knapsacks, and any other type of carrying case known (including those discussed in patents set forth herein) or yet to be discovered.

"Convertible carrying cases" are carrying cases that are convertible between at least two configurations. There are many convertible carrying cases that provide multiple ways to carry the same carrying case. Most convertible carrying cases achieve these conversions by manipulations (e.g. adding, subtracting, and/or rearranging) of straps, flaps, and other structures to change the characteristics of the carry structure and/or the main container. Examples of convertible carrying cases include U.S. Pat. No. 417,301 to Weldon (directed to a knapsack carrying case that converts between different configurations), U.S. Pat. No. 3,346,155 to Oechsle (directed to a carrying case that converts between a backpack and a purse), U.S. Pat. No. 4,273,274 to Freistadt (directed to a carrying case that converts between a backpack and a handbag), U.S. Pat. No. 4,869,408 to Lutz (directed to a carrying case that converts between a garment bag and a case for a bike carrier-rack), U.S. Pat. No. 5,749,503 to Wulf (directed to a carrying case that converts between a backpack and a wheeled suitcase), U.S. Pat. No. 5,765,733 to Brule (directed to a carrying case that converts between a backpack and a pannier for bicycling), U.S. Pat. No. 5,881,932 to Wadden (directed to a carrying case that converts between a backpack and a briefcase), U.S. Pat. No. 5,887,770 to Covell (directed to a carrying case that converts between a waist pack, day backpack, and shoulder bag), U.S. Pat. No. 5,964,384 to Young (directed to a carrying case that converts between a waist or shoulder bag and a backpack), U.S. Pat. No. 6,601,743 to Godshaw (directed to a carrying case that converts between a backpack and a duffel bag), U.S. Design Pat. No. D498,585 to Darling (directed to a carrying case that converts between a backpack and a compartmented organizer or valise), and U.S. Design Pat. No. D545,056 to Leighton (directed to a carrying case that converts between a backpack and a briefcase).

U.S. Published Application No. 2003/0042277 to Gulmatico is directed to a carrying case that converts between a backpack and an elongated sports equipment bag. This bag is designed for carrying snow boards, skis, and other lengthy sports equipment. Then, when the user reaches the sports field (e.g. mountain top), a carry harness (in a harness pouch) can be revealed and the bag can be used as a backpack. The lower portion of the elongated bag, when empty, is adapted for folded placement exteriorly to the rear panel in positional opposition to the harness pouch.

U.S. Pat. No. 4,236,657 to Brunton is directed to a backpack with shoulder straps that has a flap along one rear side edge thereof and a pair of leaves hingedly connected by a zipper to said flap. The leaves form an envelope that opens out at a right angle to the zip when the leaves are arranged in a packing position, enabling clothes to be received neatly into the envelope whereupon the leaves are wrapped around one another and the pack in a stouted position and secured. The envelope is detachable from the pack and has a handle to permit use as a release.

U.S. Pat. No. 2,493,506 to Schwartbard is directed to a reversible handbag having twin handbag portions. Each handbag portion has a first side of a first color, first grain, or first material (the first scheme) and a second side of a second color, second grain, or second material (the second scheme). The handbag portions are connected by two rings. In one configuration, the first schemes are adjacent and the second schemes are exposed on the exterior of the handbag. In another configuration, the second schemes are adjacent and the first schemes are exposed on the exterior of the handbag. The Schwartbard handbag is easily transitioned between the configuration having the exterior first scheme and the configuration having the exterior second scheme by rotating the handbag portions around the rings. This allows the wearer to adapt the scheme of the exterior handbag to match the scheme of the wearer. Schwartbard specifically discloses that each handbag portion has a single opening that remains "on top" so that it is accessible in either configuration.

U.S. Pat. No. 2,010,166 to Thompson is directed to a golf bag that can be inverted to carry with the golf club pockets on the inside or the outside. When on the inside of the Thomson golf bag, the clubs are wholly enclosed within the bag.

The Tumi Dror Benshetrit line is a collection of travel, business, and day bags that "transform" or change their shape and/or purpose. One case (the "brief") is "two cases in one" in that it transforms from a slim portfolio with a large faceted front panel to a medium capacity brief with a smaller faceted panel. This transformation is accomplished by unzipping and inverting to change shape and functionality.

All the convertible carrying cases described above have limitations as will be described herein.

BRIEF SUMMARY OF THE INVENTION

Disclosed herein is a convertible carrying case, and more specifically a convertible case that can be converted from a first configuration (emulating a first type of carrying case) to a second configuration (emulating a second type of carrying case). Convertible carrying cases such as those described herein include at least two containers. The process of conversion does not necessitate the removal or rearrangement of the contents of the containers.

A preferred convertible carrying case has a first container and a second container. The first container has a primary face and a secondary face; the primary face and the secondary face at least partially surround an interior of the first container; the primary face has a primary access structure for accessing the interior of the first container; the secondary face has a secondary access structure for accessing the interior of the first container; and the first container has a first matable half of an openable-closeable connection. The second container has a primary face and a secondary face; the primary face and the secondary face at least partially surround an interior of the second container; the primary face has a primary access structure for accessing the interior of the second container; the secondary face has a secondary access structure for accessing the interior of the second container; and the second container has a second matable half of the openable-closeable connection. A hinge connection is situated between the first container and the second container; the hinge connection facilitates the conversion between a primary configuration and a secondary configuration; the primary configuration has the primary faces facing outward while the secondary faces are adjacent to each other; and the secondary configuration with the secondary faces facing outward while the primary faces are adjacent to each other. The first matable half of the openable-closeable connection and the second matable half of the openable-closeable connection are connectable to secure the containers in either of the configurations. Preferably, contents within the containers may remain during conversion between the primary configuration and the secondary configuration. Preferably, the interiors of the containers are accessible through respective primary access structure in respective primary faces when the convertible carrying case is in the primary configuration, and wherein the interiors of the containers are accessible through respective secondary access structure in respective secondary faces when the convertible carrying case is in the secondary configuration. Preferably, the primary configuration emulates a first type of carrying case and the secondary configuration emulates a secondary type of carrying case. Preferably, the primary configuration emulates a first type of carrying case that has a first orientation and the secondary configuration emulates a secondary type of carrying case that has a secondary orientation, the first orientation being horizontal and the second orientation being vertical. Preferably, at least one of the configurations has a compartment defined between the first container and the second container. Preferably, the configurations are a backpack configuration and a briefcase configuration. Preferably, the convertible carrying case further includes a tertiary configuration, the configurations being a backpack configuration, a briefcase configuration, and a saddlebag configuration. Preferably, each container has an annular extension, at least part of each of the annular extensions associated with the hinge connection, at least part of the remainder of the annular extensions associated with respective matable halves of the openable-closeable connection. Preferably, in convertible carrying cases having annular extensions, the annular extensions associated with respective matable halves bend towards each other to allow the openable-closeable connection to secure the convertible carrying case in one of the configurations.

The first container has a primary face and a secondary face; the primary face and the secondary face at least partially surround an interior of the first container; the primary face has a primary access structure for accessing the interior of the first container; the secondary face has a secondary access structure for accessing the interior of the first container; and the first container has a first matable half of an openable-closeable connection. The second container has a primary face and a secondary face; the primary face and the secondary face at least partially surround an interior of the second container; the primary face has a primary access structure for accessing the interior of the second container; the secondary face has a secondary access structure for accessing the interior of the second container; and the second container has a second matable half of the openable-closeable connection. A hinge connection is situated between the first container and the second container; the hinge connection facilitates the conversion between a primary configuration and a secondary configuration; the primary configuration has the primary faces facing outward while the secondary faces are adjacent to each other; and the secondary configuration with the secondary faces facing outward while the primary faces are adjacent to each other. The interiors of the containers are accessible through respective primary access structure in respective primary faces when the convertible carrying case is in the primary configuration; and wherein the interiors of the containers are accessible through respective secondary access structure in respective secondary faces when the convertible carrying case is in the secondary configuration. Preferably, the contents within the containers may remain during conversion between the primary configuration and the secondary configuration. Preferably, the primary configuration emulates a first type of carrying case and the secondary configuration emulates a second type of carrying case. Preferably, the primary configuration emulates a first type of carrying case that has a first orientation and the secondary configuration emulates a second type of carrying case that has a secondary orientation, the first orientation being horizontal and the second orientation being vertical. Preferably, at least one of the configurations has a compartment defined between the first container and the second container. Preferably, the configurations are a backpack configuration and a briefcase configuration. Preferably, the convertible carrying case further includes a tertiary configuration, the configurations being a backpack configuration, a briefcase configuration, and a saddlebag configuration. Preferably, each container has an annular extension, at least part of each of the annular extensions associated with the hinge connection, at least part of the remainder of the annular extensions associated with respective matable halves of the openable-closeable connection. Preferably, in convertible carrying cases having annular extensions, the annular extensions associated with respective matable halves bend towards each other to allow the openable-closeable connection to secure the convertible carrying case in one of the configurations.

A method for converting a convertible carrying case between a primary configuration and a secondary configuration. The method includes the steps of providing a first container and a second container as described herein. Another step is rotating at least one of the first and second containers about a longitudinal hinge connection, the hinge connection between the first container and the second container, the rotating converting the convertible carrying case in the primary configuration with the primary faces facing outward while the secondary faces are adjacent to each other to the secondary configuration with the secondary faces facing outward while the primary faces are adjacent to each other. Yet another step is flipping the annular extensions to allow the first matable half of the openable-closeable connection and the second matable half of the openable-closeable connection connectable to secure the containers in either of the configurations. The containers are accessible through the primary access structure when the convertible carrying case is in the primary configuration and accessible through the secondary access structure when the convertible carrying case is in the secondary configuration.

The subject matter described herein is particularly pointed out and distinctly claimed in the concluding portion of this specification. Objectives, features, combinations, and advantages described and implied herein will be more readily understood upon consideration of the following detailed description of the invention, taken in conjunction with the accompanying drawings.

BRIEF DESCRIPTION OF THE SEVERAL VIEWS OF THE DRAWINGS

The accompanying drawings illustrate various exemplary convertible carrying cases and/or provide teachings by which the various exemplary convertible carrying cases are more readily understood.

Figure 1:
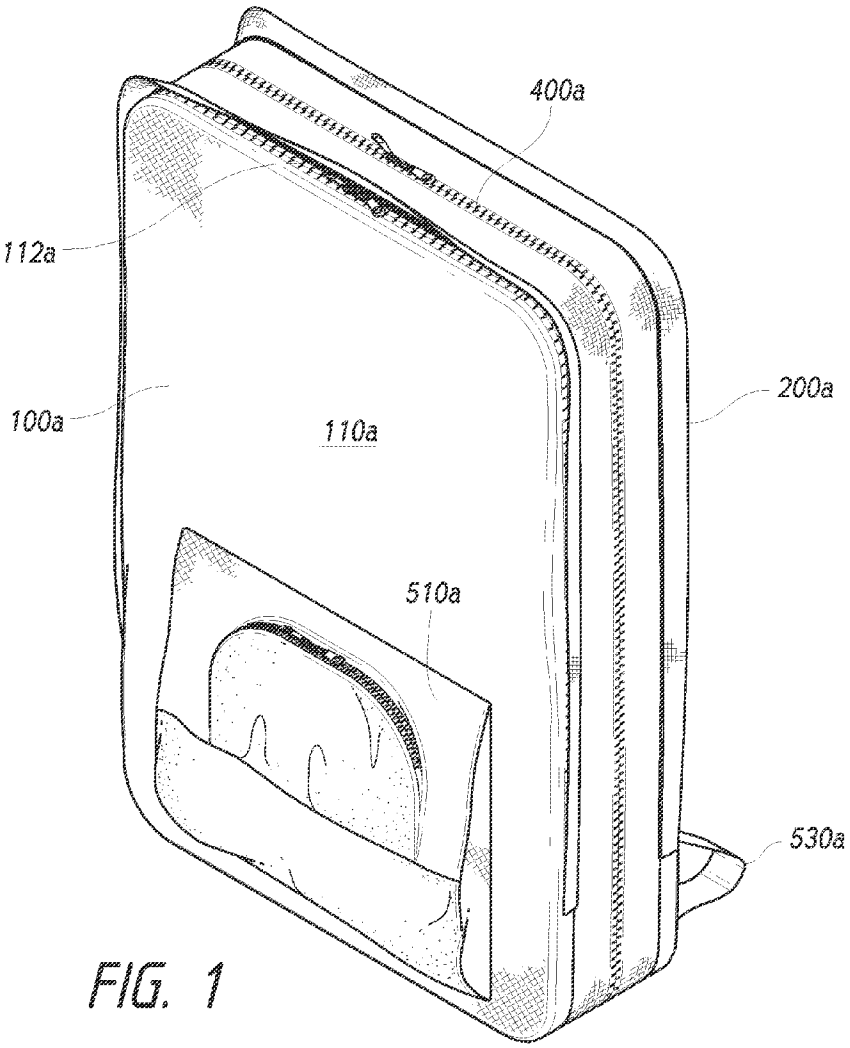
FIG. 1 is a front perspective view of a first exemplary convertible carrying case configured as a backpack.
Figure 2:
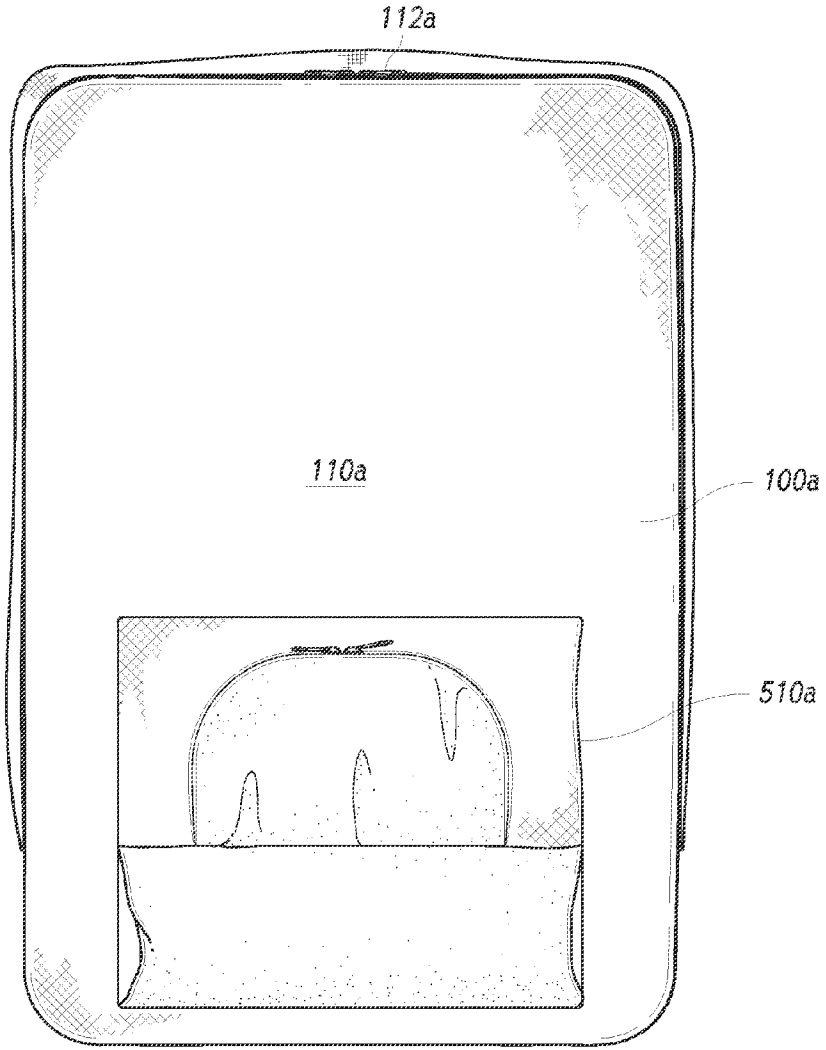
FIG. 2 is a front view of the first exemplary convertible carrying case configured as a backpack.
Figure 3:
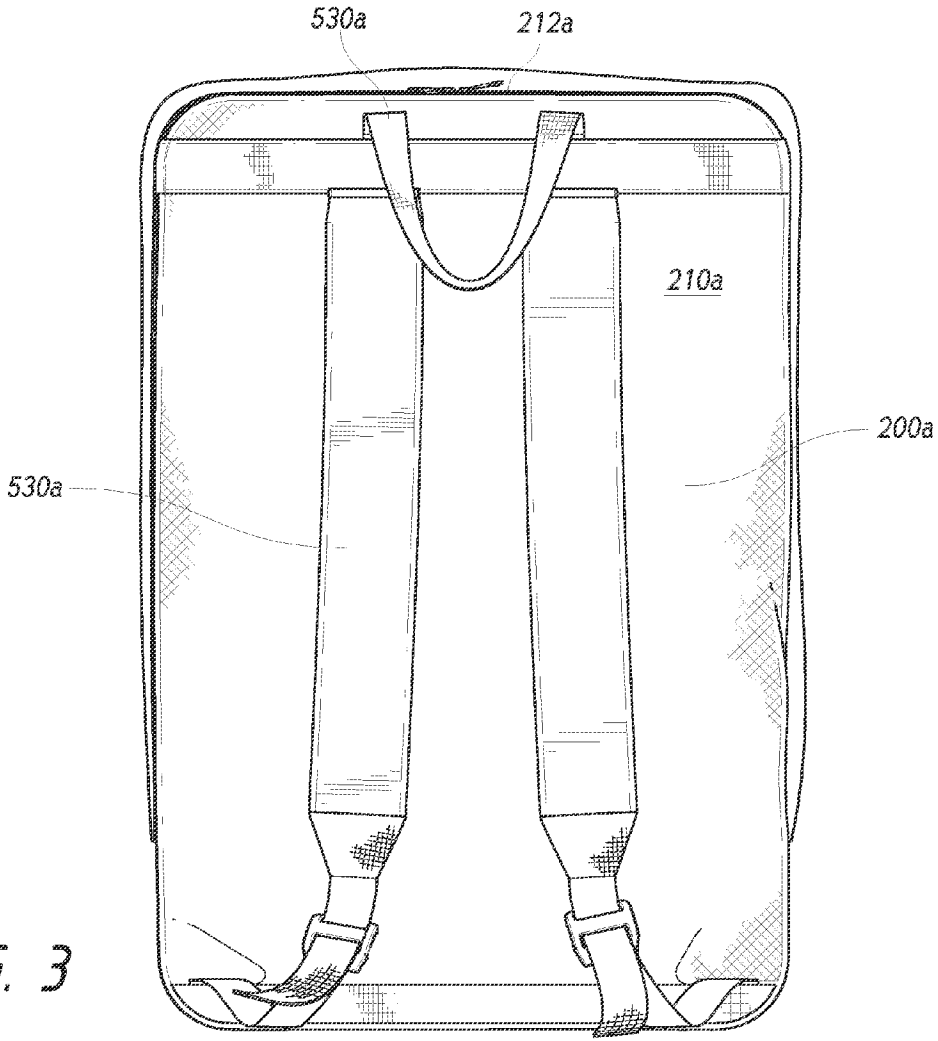
FIG. 3 is a rear view of the first exemplary convertible carrying case configured as a backpack.
Figure 4:
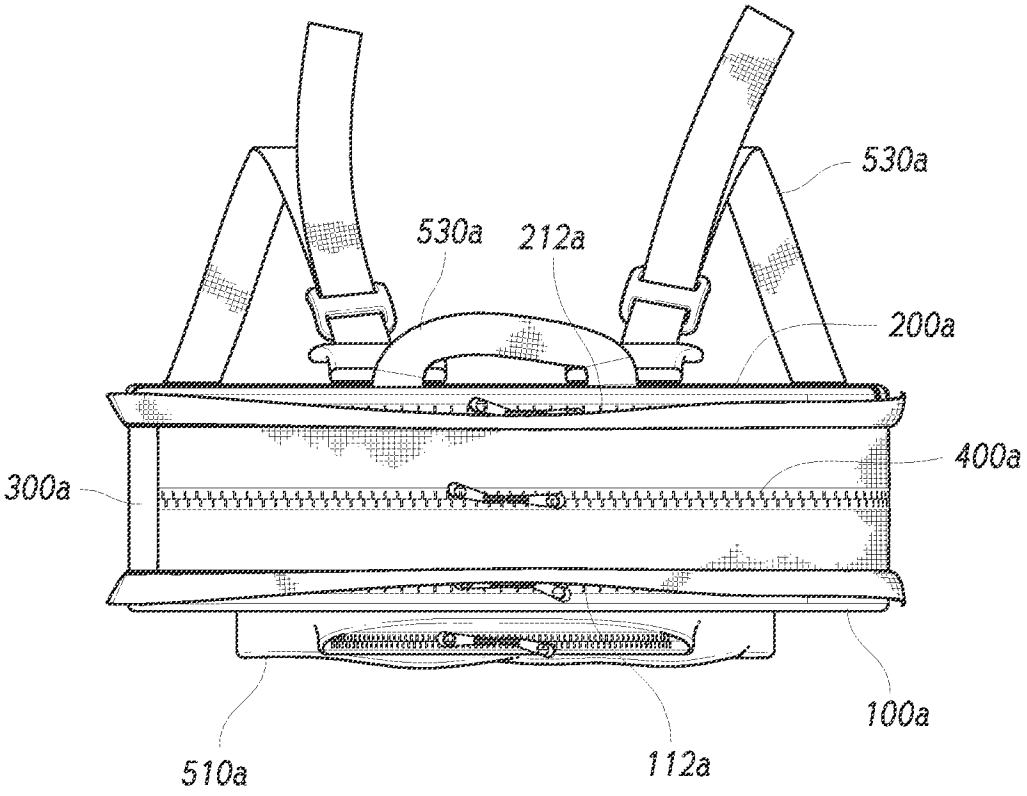
FIG. 4 is a top view of the first exemplary convertible carrying case configured as a backpack.
Figure 5:
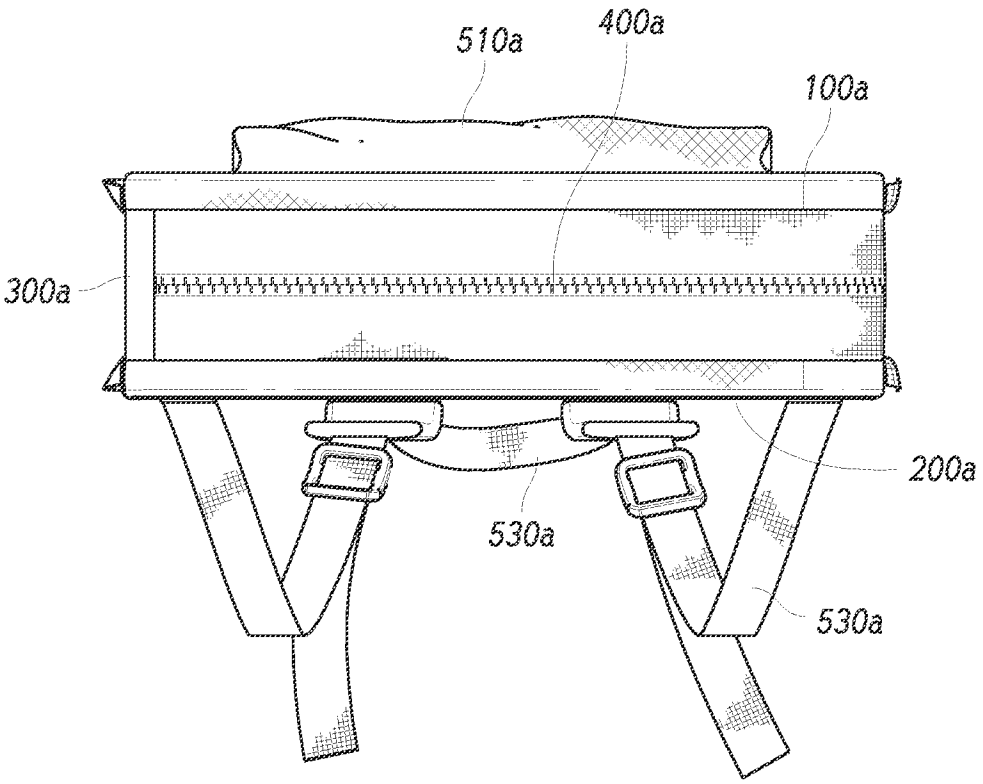
FIG. 5 is a bottom view of the first exemplary convertible carrying case configured as a backpack.
Figure 6:
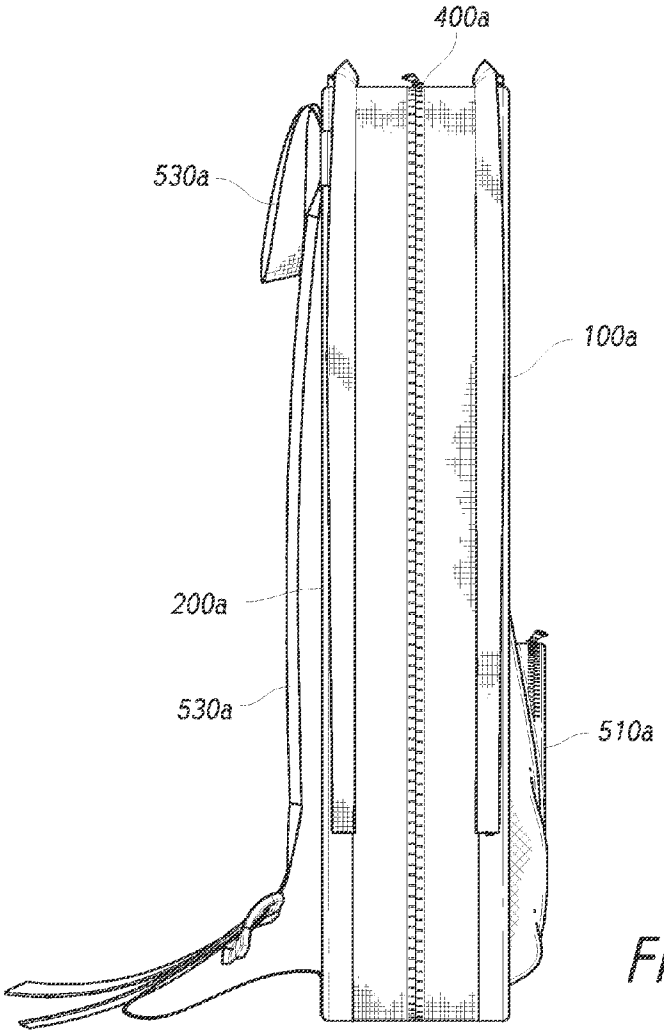
FIG. 6 is a first side view of the first exemplary convertible carrying case configured as a backpack.
Figure 7:
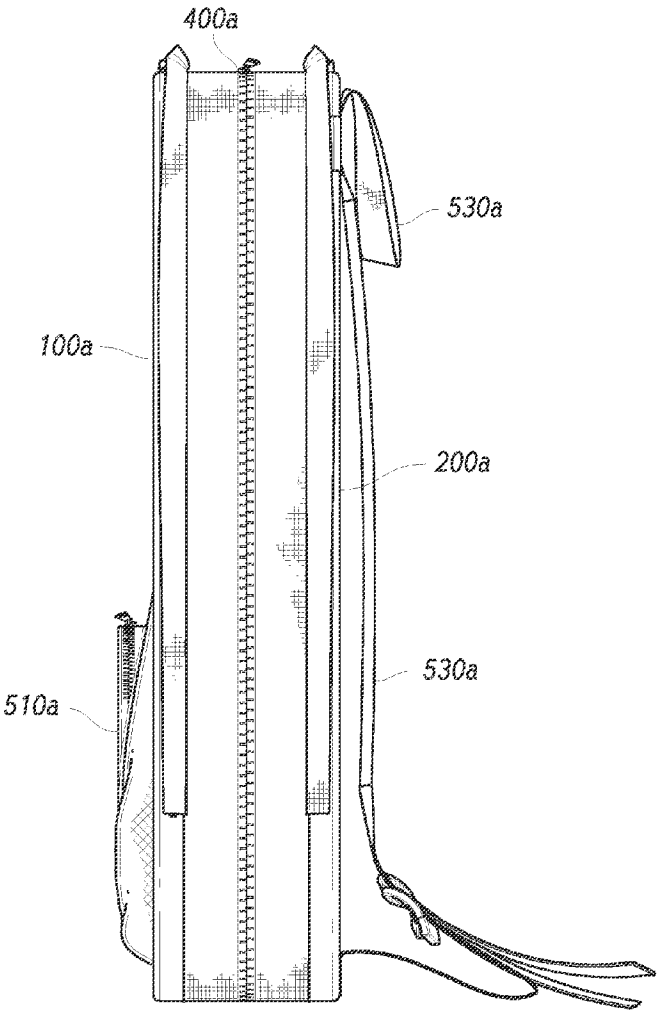
FIG. 7 is a second side view of the first exemplary convertible carrying case configured as a backpack.

The drawing figures are not necessarily to scale. Certain features or components herein may be shown in somewhat schematic form and some details of conventional elements may not be shown or described in the interest of clarity and conciseness. The drawing figures are hereby incorporated in and constitute a part of this specification.

DETAILED DESCRIPTION OF THE INVENTION

Disclosed herein are convertible carrying cases, and more specifically convertible carrying cases that can be converted from a primary or first configuration (emulating a primary or first type of carrying case) to a secondary or second configuration (emulating a secondary or second type of carrying case). The first and second types (and therefore the configurations) may be the same or may be different. The first and second types (and therefore the configurations) may have the same or different orientations (e.g. both horizontal, both vertical, or one horizontal and one vertical).

Convertible carrying cases such as those described herein include at least two containers (referred to generally as Container #1 (or container 100) and Container #2 (or container 200)). The process of conversion does not necessitate the removal or rearrangement of the contents of the containers 100, 200.

In its simplest form, each of the two containers 100, 200 of a preferred convertible carrying case has two faces (Face A or the primary face and Face B or the secondary face). Face A of Container #1 is referred to as face 110, Face B of Container #1 is referred to as face 120, Face A of Container #2 is referred to as face 210, and Face B of Container #2 is referred to as face 220. Each face 110, 120, 210, 220 of each container 100, 200 has access structure 112, 122, 212, 222 that allows access into the interior of its respective container 100, 200. To be clear, each container 100, 200 has two access structures (one primary access structure and one secondary access structure), one associated with each face (primary access structures associated with primary faces and secondary access structures associated with secondary faces).

The two containers 100, 200 are connected together along an adjacent edge of each container 100, 200 using a hinge connection 300. The remaining periphery of each container 100, 200 have a matable half 410, 420 of an openable-closeable connection 400. The hinge connection 300 allows transitioning between (conversion) two folded configurations: a primary configuration has the primary faces (e.g. Faces A or faces 110, 210) facing outward while the secondary faces (e.g. Faces B or faces 120, 220) are adjacent to each other, and a secondary configuration has the secondary faces (e.g. Faces B or faces 120, 220) facing outward while the primary faces (e.g. Faces A or faces 110, 210) are adjacent to each other. When the two containers 100, 200 are in a folded configuration such that the two containers 100, 200 are substantially coextensive, the openable-closeable connection 400 can be closed (the matable halves 410, 420 joined together) to hold the containers 100, 200 in that position and to create a compartment 450 (FIG. 41) therebetween.

FIGS. 1-20 show first exemplary convertible carrying case that converts between a backpack configuration and a briefcase configuration. FIGS. 1-7 show the backpack configuration. FIGS. 8-13 show a simplified carrying case (without, for example, the optional pockets) exemplary conversion process between the backpack configuration and the briefcase configuration. FIGS. 14-20 show the briefcase configuration. The general reference numbers have been modified with "a" with the following as examples: Container #1 is container 100*a*, Container #2 is container 200*a*, Face A of Container #1 is face 110*a*, Face B of Container #1 is face 120*a*, Face A of Container #2 is face 210*a*, Face B of Container #2 is face 220*a*, hinge connection 300*a*, openable-closeable connection 400*a*, the matable halves of the openable-closeable connection are half 410*a* and half 420*a*.

Figure 21:
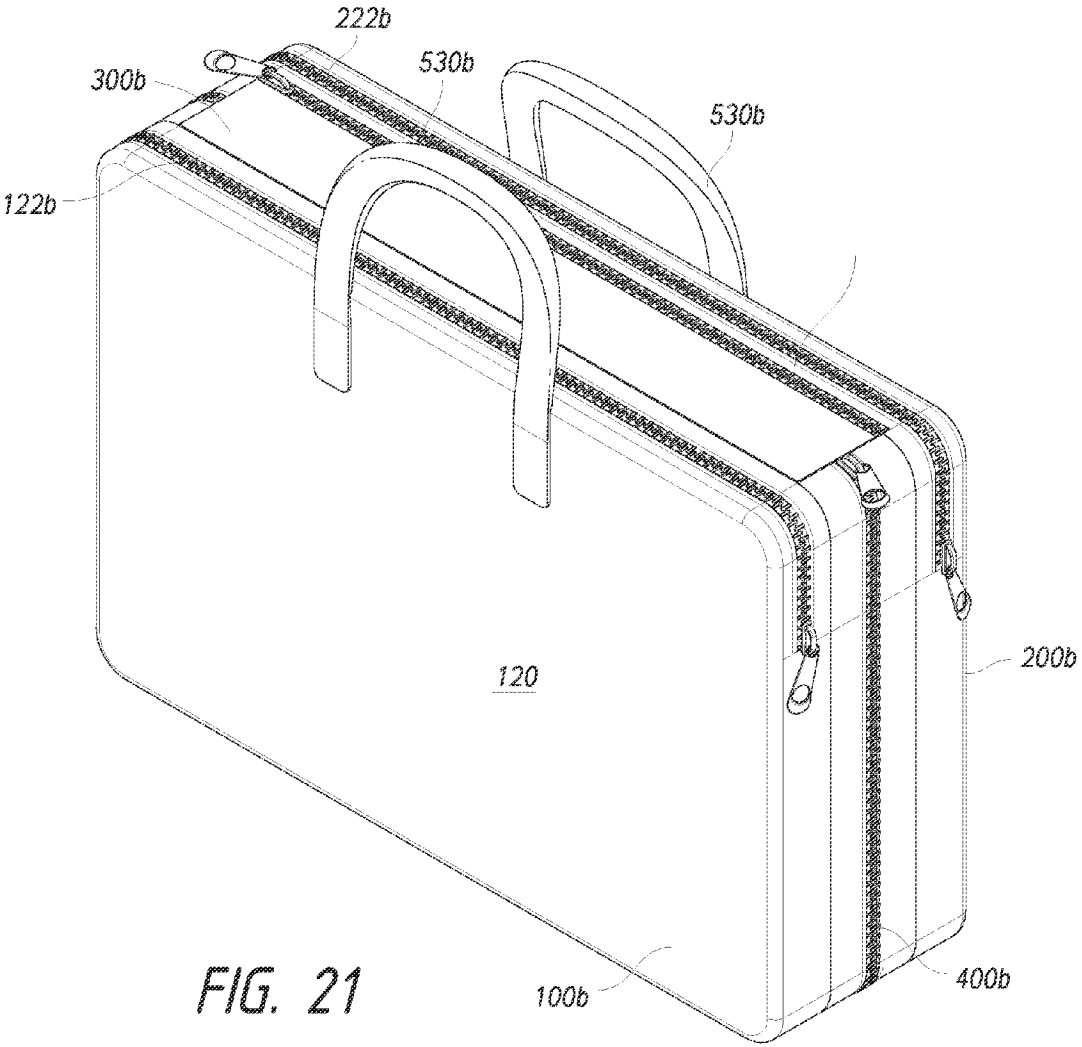
FIG. 21 is a front perspective view of a second exemplary convertible carrying case configured as a briefcase.
Figure 23:
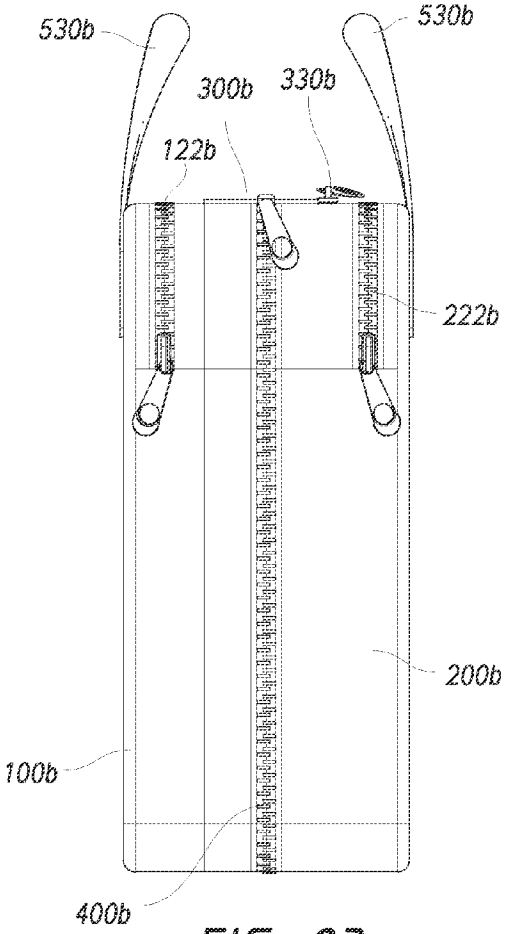
FIG. 23 is a side view of the second exemplary convertible carrying case configured as a briefcase.
Figure 22:
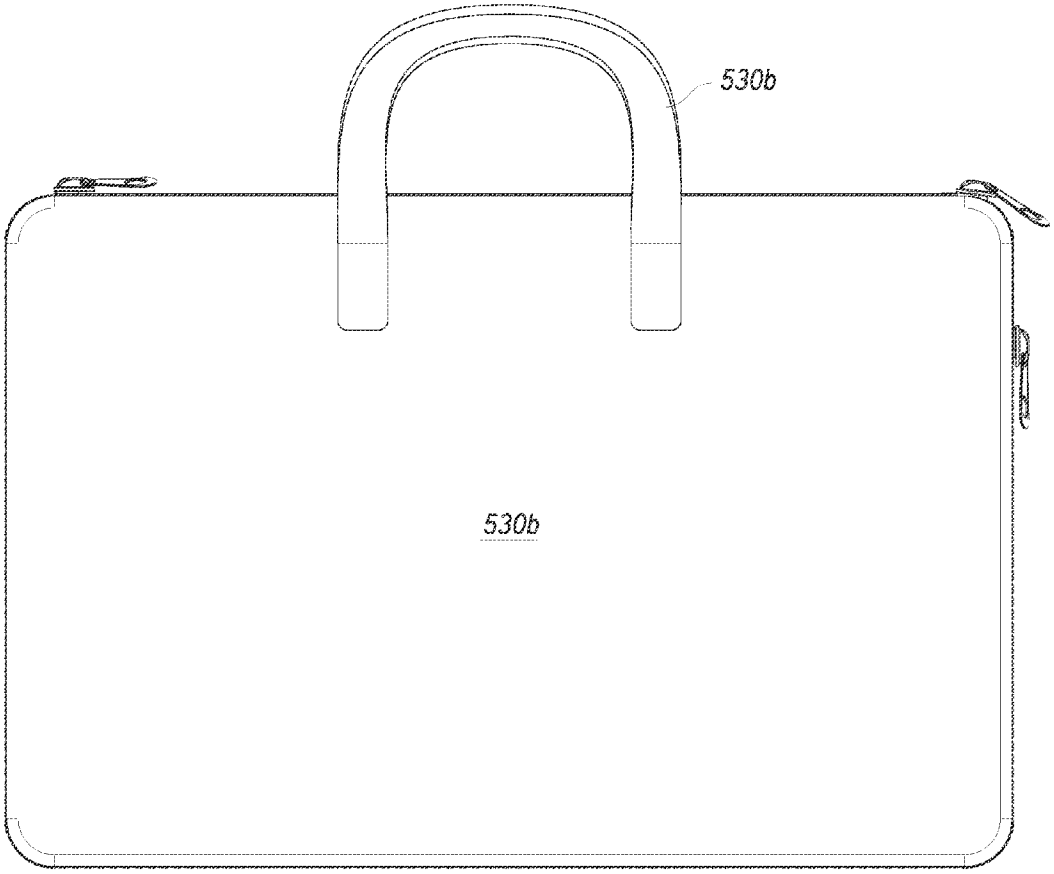
FIG. 22 is a front view of the second exemplary convertible carrying case configured as a briefcase.
Figure 24:
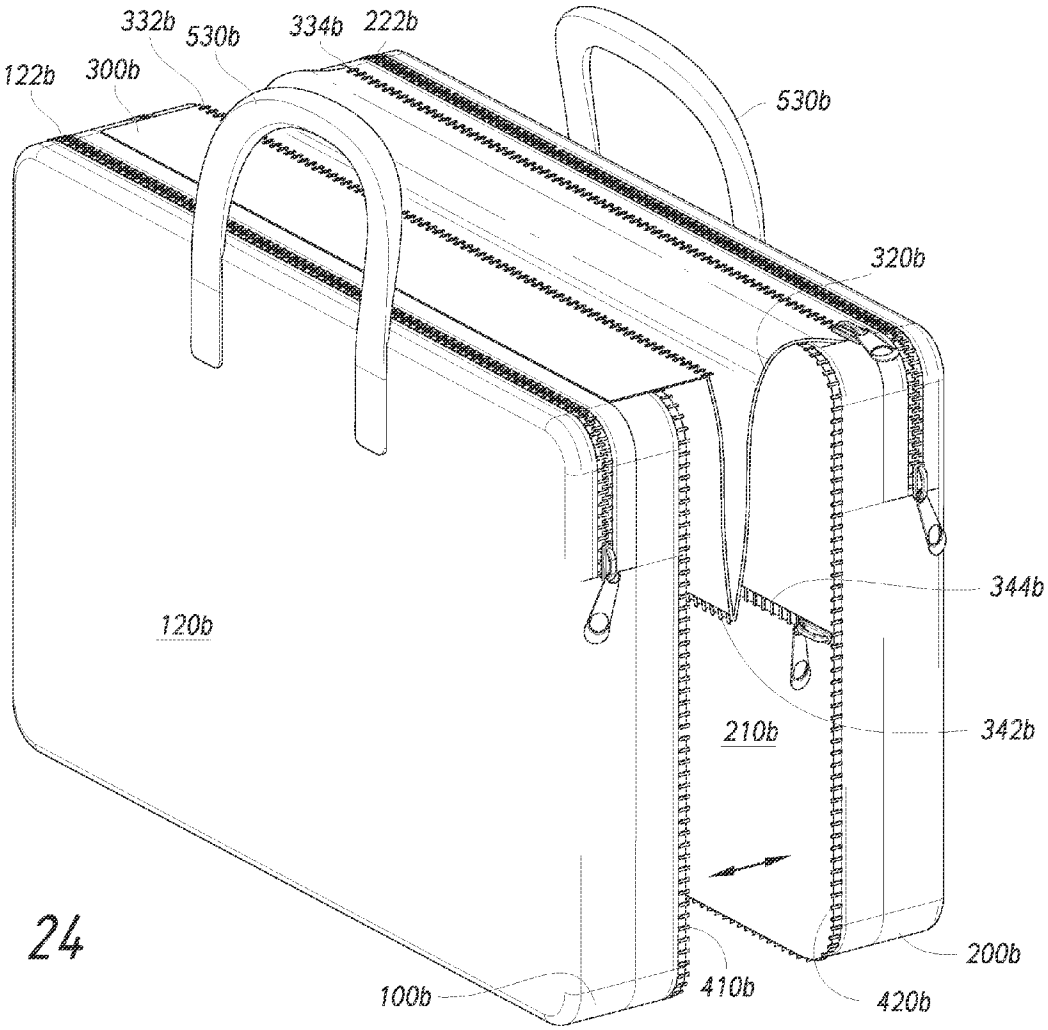
FIGS. 24-25 are perspective views of the second exemplary convertible carrying case with the two containers separated to expose the spanning yoke.
Figure 25:
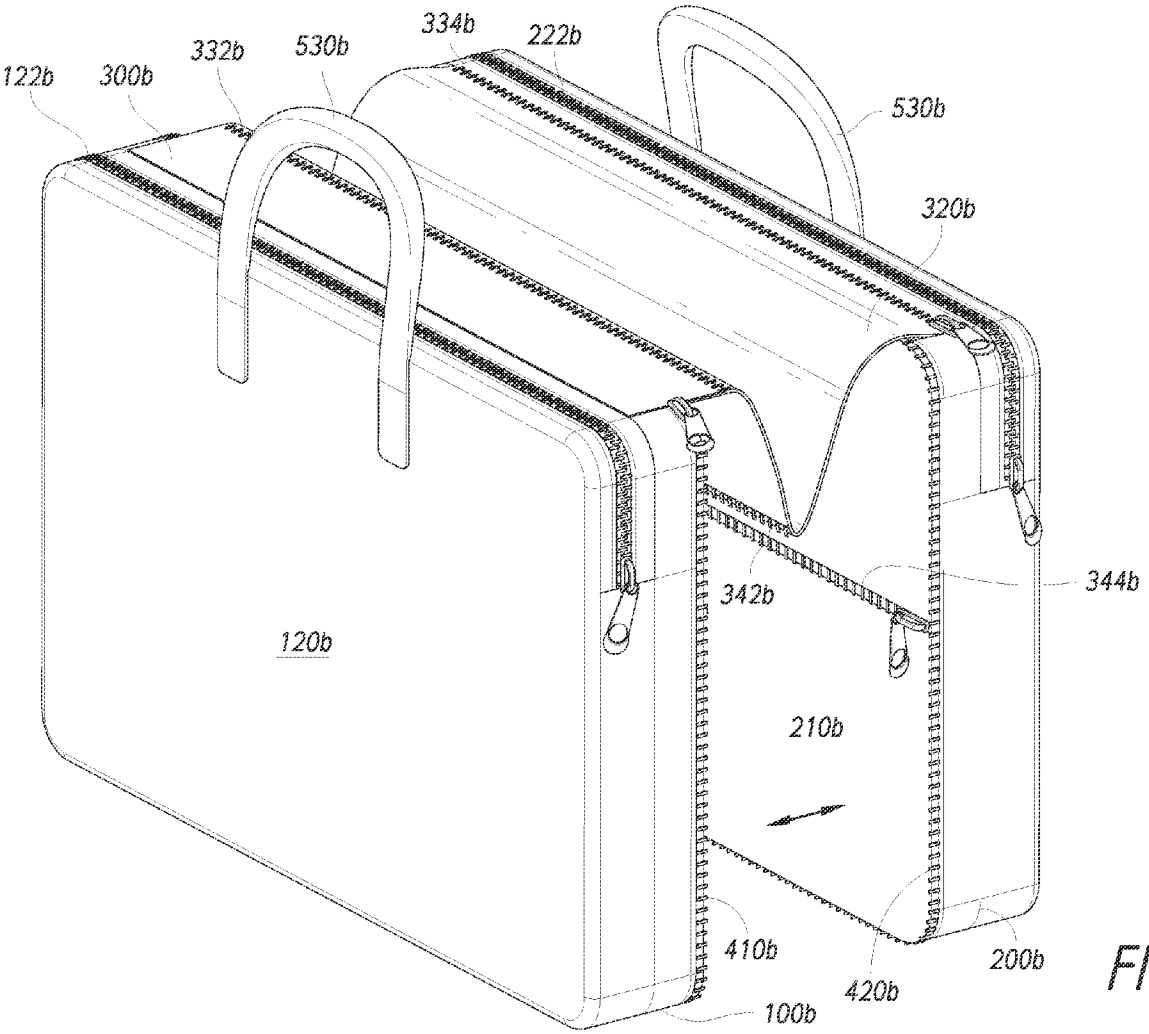
Figure 26:
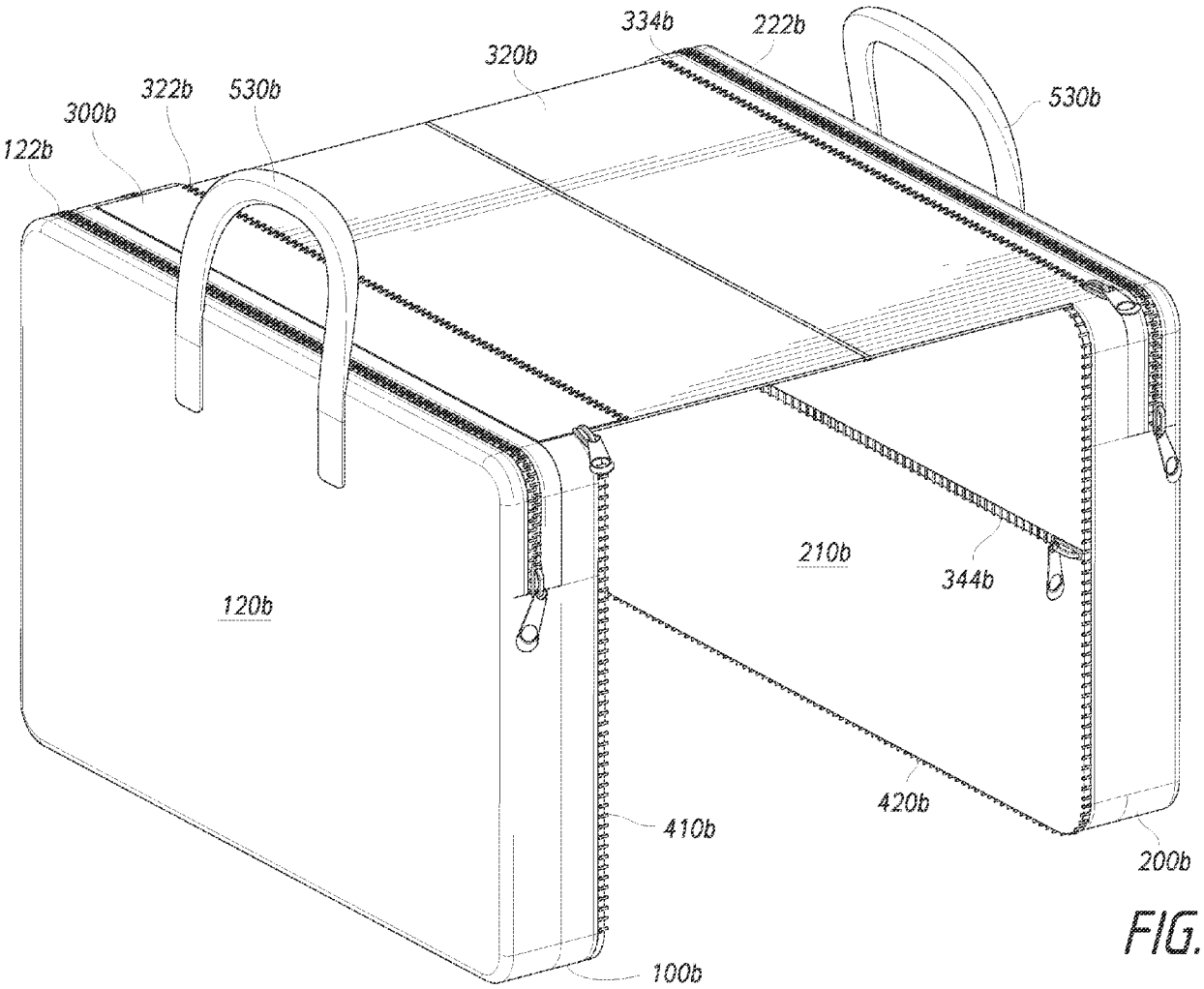
FIG. 26 is a perspective view of the second exemplary convertible carrying case with the two containers separated and the spanning yoke in its fully extended position such that the second exemplary convertible carrying case may be used as a saddlebag.
Figure 27:
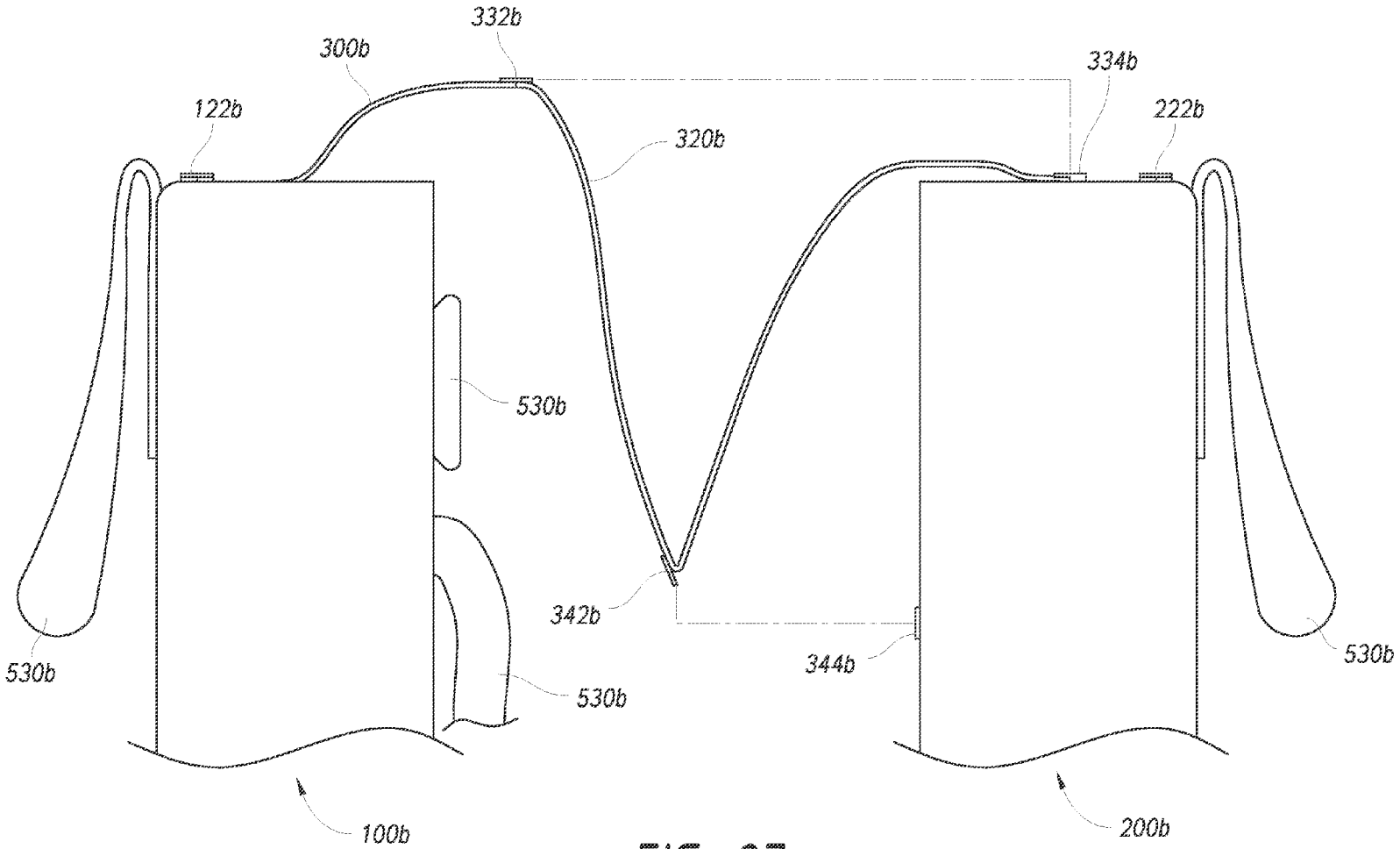
FIG. 27 is a cross-sectional view of the top portions of the two containers of the second exemplary convertible carrying case, the two containers separated, and the spanning yoke disconnected (but with guide lines showing the intended connections).
Figure 28:
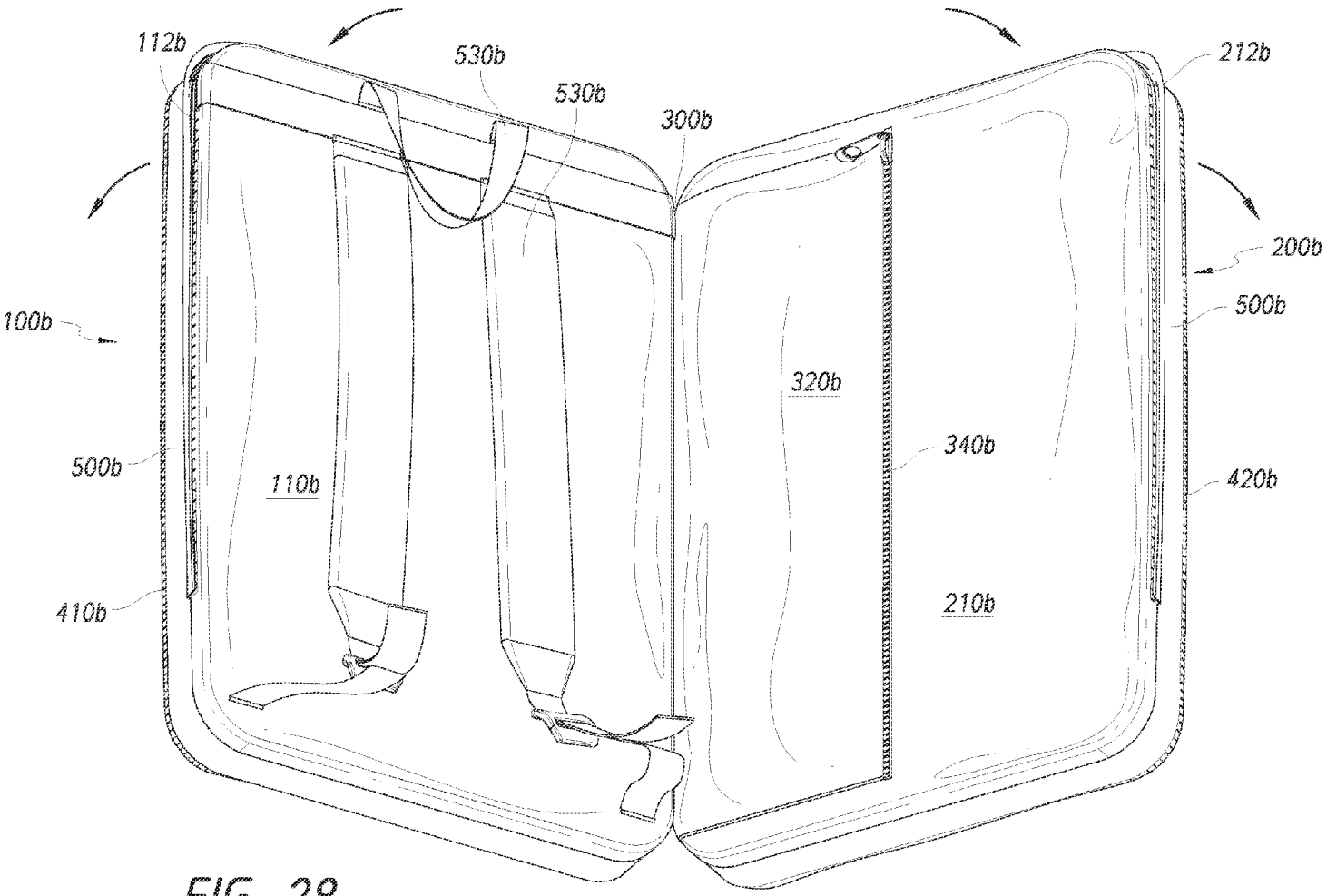
FIG. 28 is a perspective view of the second exemplary convertible carrying case in the process of conversion, the spanning yoke secured to the face of a container.
Figure 29:
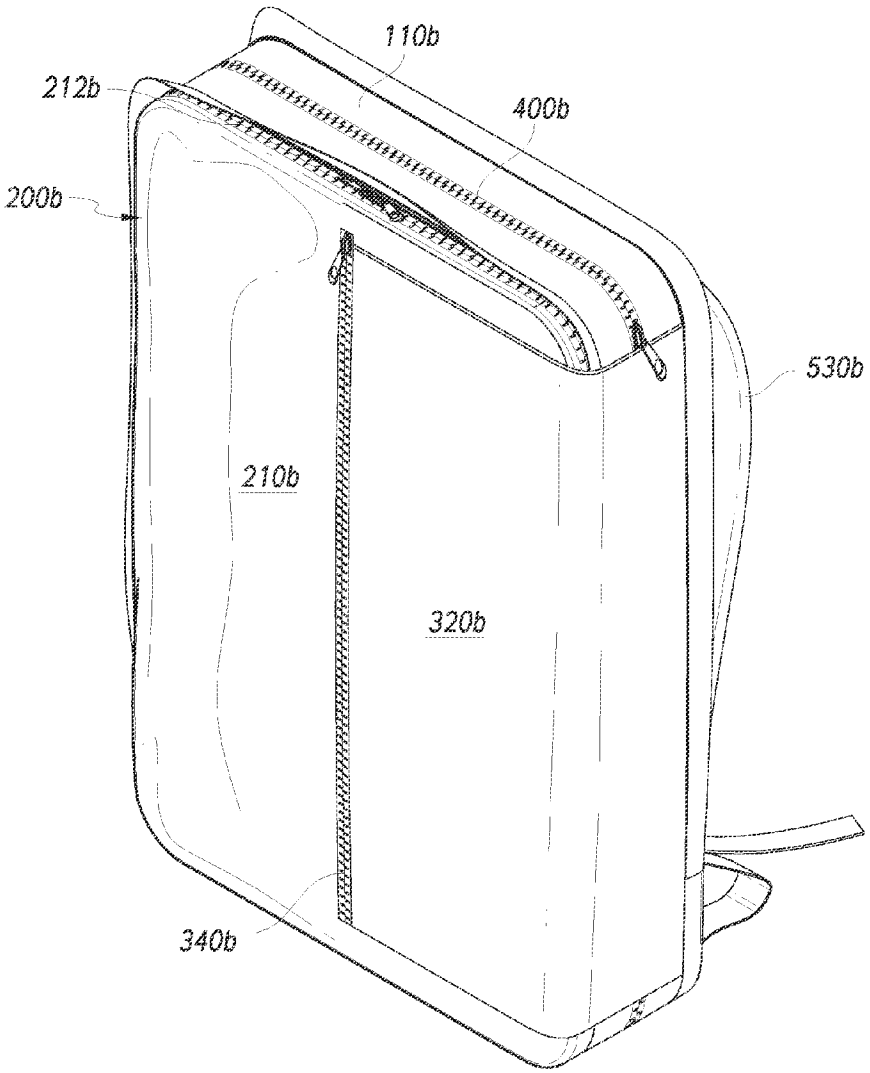
FIG. 29 is a front perspective view of the second exemplary convertible carrying case configured as a backpack, the spanning yoke secured to the face of a container.

FIGS. 21-29 show second exemplary convertible carrying case that converts between a backpack configuration and a briefcase configuration. Further, this second exemplary convertible carrying case has an additional saddlebag configuration to which it can also be converted. This equates to a convertible carrying case having a primary configuration, a secondary configuration, and a tertiary configuration. FIGS. 21-23 show an exemplary briefcase configuration. FIGS. 24-25 show an exemplary conversion between the briefcase configuration and the saddlebag configuration. FIG. 26 shows an exemplary saddlebag configuration with a spanning yoke 320*b* fully extended. FIG. 27 shows attachment guide lines representing how the spanning yoke could be secured in an exemplary conversion between the briefcase configuration and the backpack configuration (as well as when the carrying case is in either the briefcase configuration or the backpack configuration). FIG. 28 shows an exemplary intermediate step in an exemplary conversion between the briefcase configuration and the backpack configuration. FIG. 29 shows an exemplary backpack configuration. The general reference numbers have been modified with "b" with the following as examples: Container #1 is container 100*b*, Container #2 is container 200*b*, Face A of Container #1 is face 110*b*, Face B of Container #1 is face 120*b*, Face A of Container #2 is face 210*b*, Face B of Container #2 is face 220*b*, hinge connection 300*b*, openable-closeable connection 400*b*, the matable halves of the openable-closeable connection are half 410*b* and half 420*b*. FIGS. 21-29 also have reference numbers associated with the spanning yoke 320*b* including a spanning yoke openable-closeable connections 330*b*, 340*b*. "Hinge" spanning yoke openable-closeable connection 330*b* (implemented as two matable halves 332*b*, 334*b*) secures the "loose" side of the hinge connection 300*b* to the opposite container 200*b*. "Flap" spanning yoke openable-closeable connection 340*b* (implemented as two matable halves 342*b*, 344*b*) secures the "flap" created by the folded spanning yoke 320*b* to the face 201*b* of the opposite container 200*b*.

Alternative convertible carrying cases convert between two backpack carrying cases or between two briefcase carrying cases, for example, to change colors or fabrics on the exterior surface. Still other alternative convertible carrying cases convert between any combination of backpacks, briefcases, purses, handbags, totes, satchels, camera bags, duffle bags, shoulder bags, clothes bags, garment bags, artist easels, makeup bags, computer bags, messenger bags, diaper bags, fishing bags, tack bags, saddle bags, panniers, luggage, suitcases, travel bags, knapsacks, and any other type of carrying case known (including those discussed in patents set forth herein) or yet to be discovered. Specific materials (e.g. soft materials such as fabrics, rigid materials such as metals, or hybrid materials such as leather that are not completely soft or rigid) and features (e.g. accessory holders such as pockets and pouches and carry structure such as handles and straps) would be consistent with the specific carrying cases used.

Definitions

Before describing the convertible carrying case and the figures, some of the terminology should be clarified. Please note that the terms and phrases may have additional definitions and/or examples throughout the specification. Where otherwise not specifically defined, words, phrases, and acronyms are given their ordinary meaning in the art. Exemplary convertible carrying cases case may be better understood with reference to the drawings, but these convertible carrying cases case are not intended to be of a limiting nature. The following paragraphs provide some of the definitions for terms and phrases used herein.

The term "container" is meant to describe an at least substantially enclosed structure that can be used to hold and/or transport objects within it. Each container preferably has two panels or faces (shown as Face A and Face B). Each face has an internal surface that is internal to the container and an external surface. Exemplary containers may be, for example, pouches (with soft faces made of material), boxes (with rigid faces), and/or hybrid structures (either with one soft face and one rigid face or with faces that have a mid-level stiffness between hard and soft). General and exemplary containers are designated by reference numbers 100*a*, 100*b*, 200*a*, and 200*b*. General and exemplary faces are designated by reference numbers 110, 120, 210, 220, 110*a*, 120*a*, 210*a*, 220*a*, 110*b*, 120*b*, 210*b*, and 220*b*.

The phrase "access structure" is meant to describe structure that allows access. In its simplest form, the access structure is an opening that has associated openable-closeable mechanisms such as a zipper, hook-and-loop fabric (e.g. VELCRO®), a series of small openable-closeable mechanisms (e.g. snaps, buttons, hooks & eyes), straps, buckles, or any other openable-closeable mechanism known or yet to be discovered. Preferably there is at least one access structure on each face of each container. Having access structure on each face allows a user to access the container regardless of which face is facing outward. General and exemplary access structures are designated by reference numbers 112, 122, 212, 222, 112*a*, 122*a*, 212*a*, 222*a*, 112*b*, 122*b*, 212*b*, and 222*b*.

The term "connection" is meant to describe mechanisms used for attaching. Two "connections" used in the convertible carrying cases disclosed herein are "hinge connections" (general and exemplary hinge connections are designated by reference numbers 300, 300*a*, and 300*b*) and "openable-closeable connections" (general and exemplary openable-closeable connections are designated by reference numbers 400, 400*a*, and 400*b*). Hinge connections may function as a hinge between two containers. A hinge connection may be, for example, an expanse of fabric sewn between two containers 100, 200. An openable-closeable connection is both openable (to allow separation) and closeable (to prevent separation). An openable-closeable connection 400 is generally implemented as two matable halves (general and exemplary matable halves are designated by reference numbers 410, 420, 410*a*, 420*a*, 410*b*, and 420*b*). An openable-closeable connection may be, for example, a zipper, one side of which is associated with one container and the other side of which is associated with the other container. Alternative openable-closeable connections may be hook-and-loop fabric (e.g. VELCRO®), a series of small openable-closeable mechanisms (e.g. snaps, buttons, hooks & eyes), straps, buckles, or any other openable-closeable mechanism known or yet to be discovered. It should be noted that a hinge connection may also be an openable-closeable connection or have openable-closeable connections associated therewith. Two specialized openable-closeable connections used with the saddlebag configuration are the "hinge" spanning yoke openable-closeable connection 330*b* (implemented as two matable halves 332*b*, 334*b*) and the "flap" spanning yoke openable-closeable connection 340*b* (implemented as two matable halves 342*b*, 344*b*).

Figure 8:
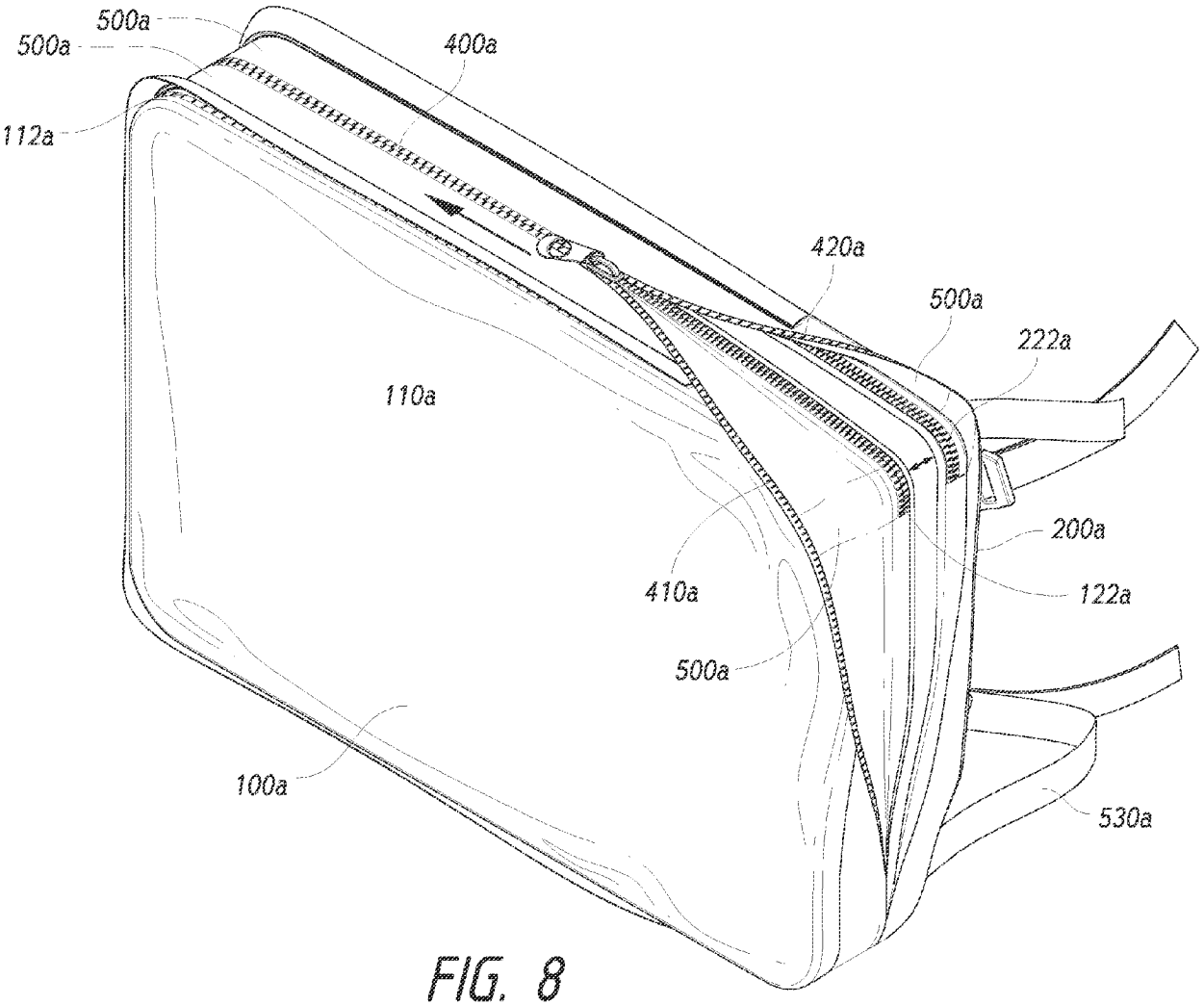
FIGS. 8-13 are views of a simplified exemplary convertible carrying case going through the conversion process between a backpack and a briefcase.
Figure 9:
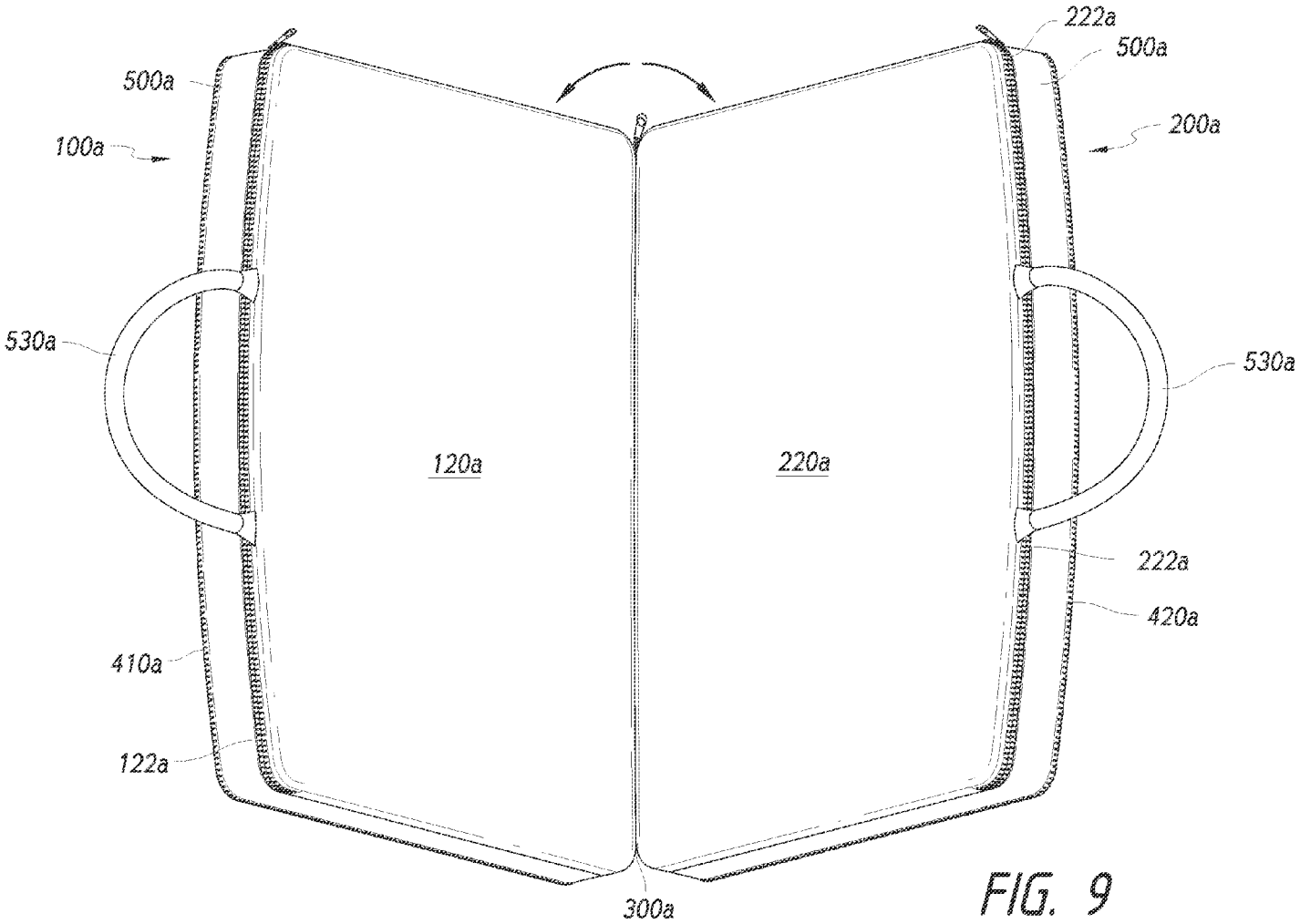
Figure 10:
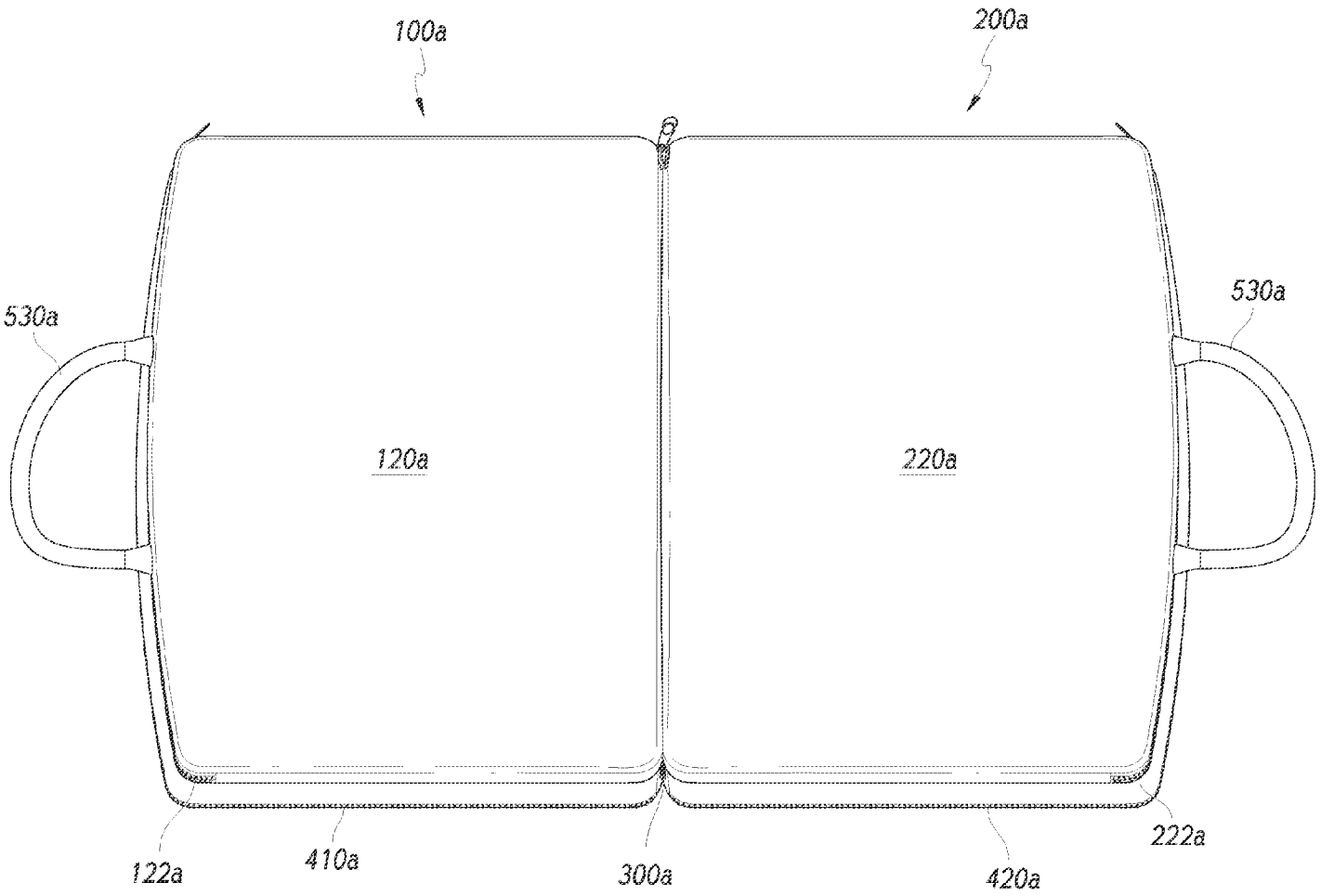
Figure 11:
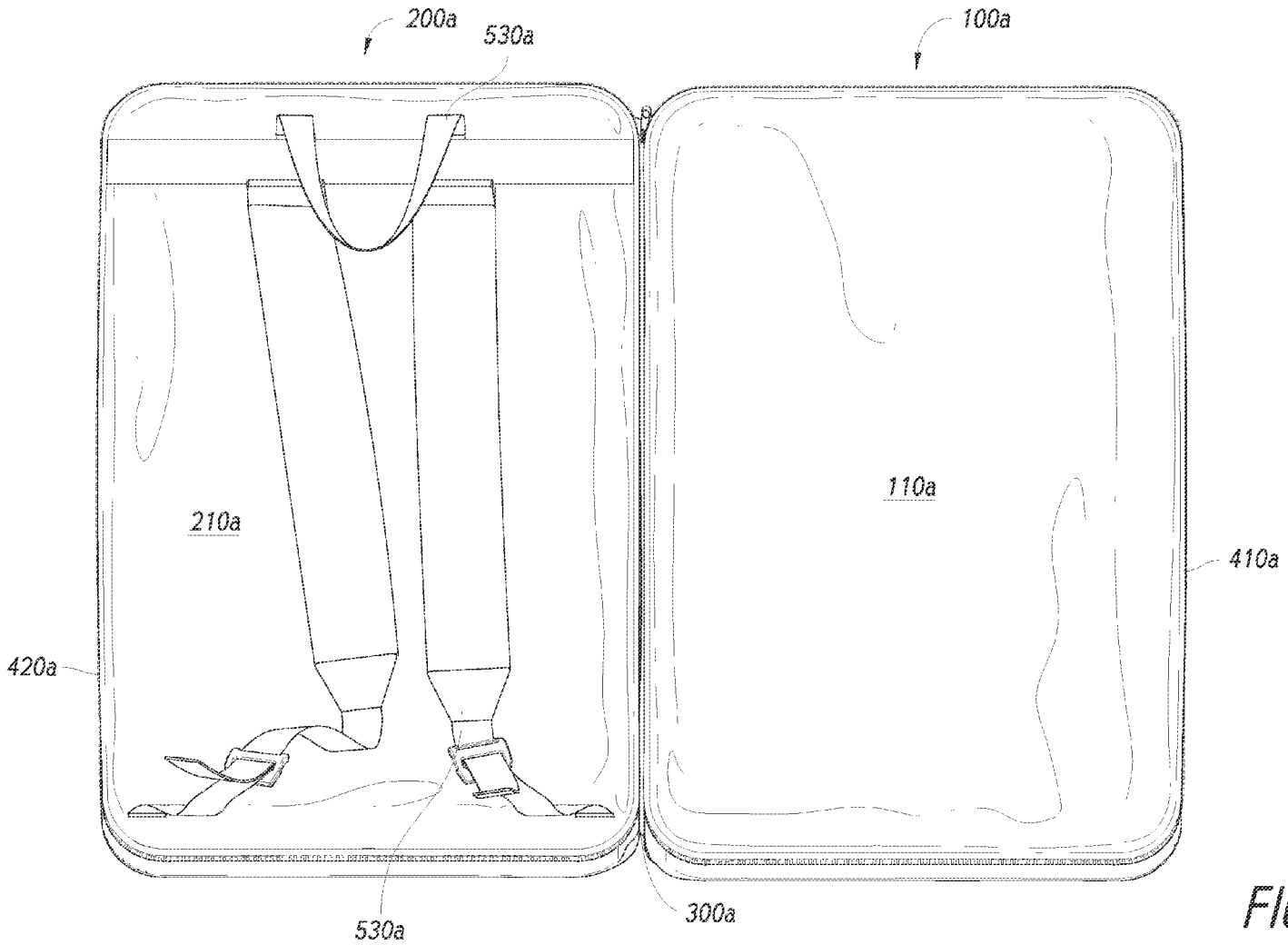
Figure 12:
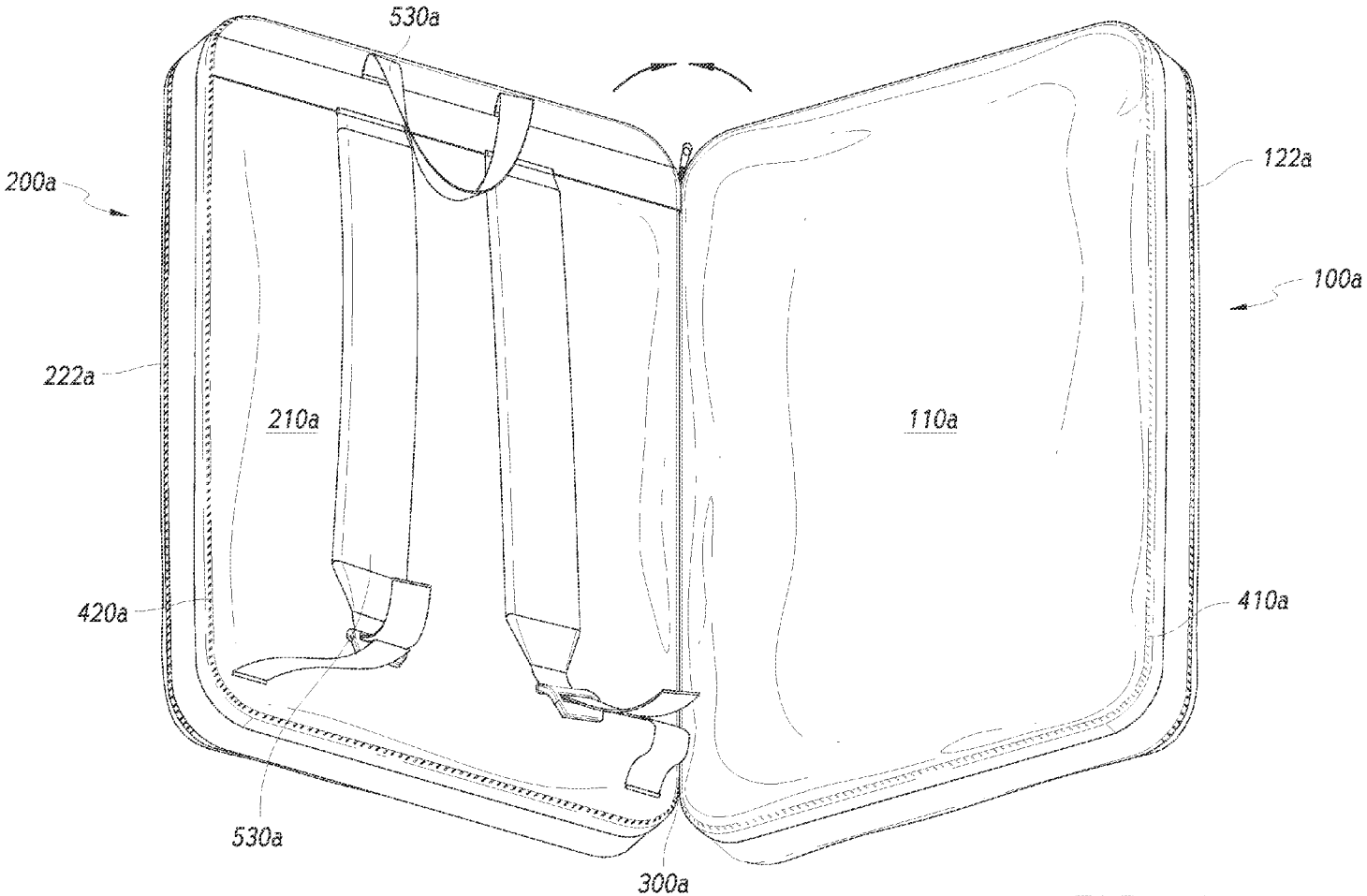
Figure 13:
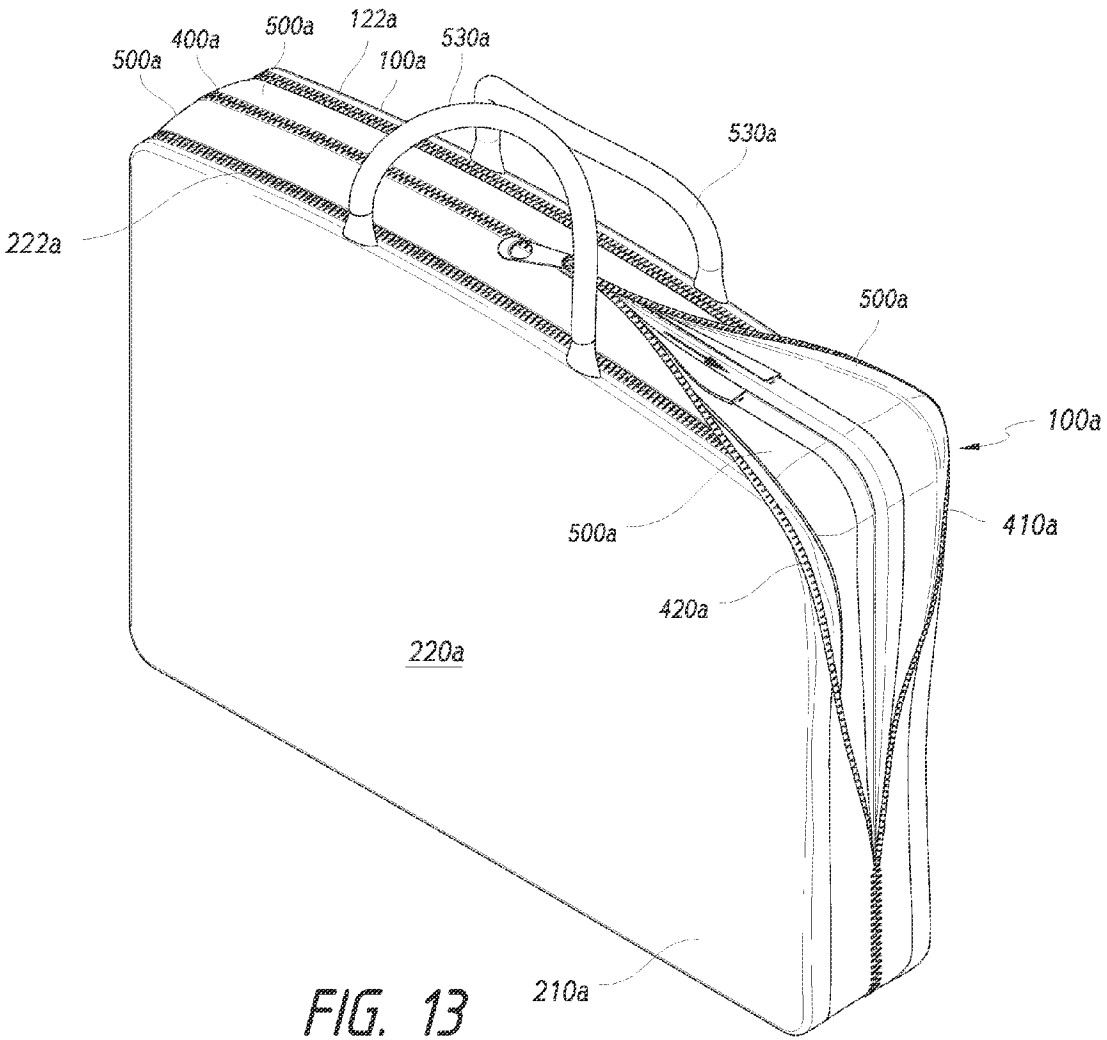
Figure 14:
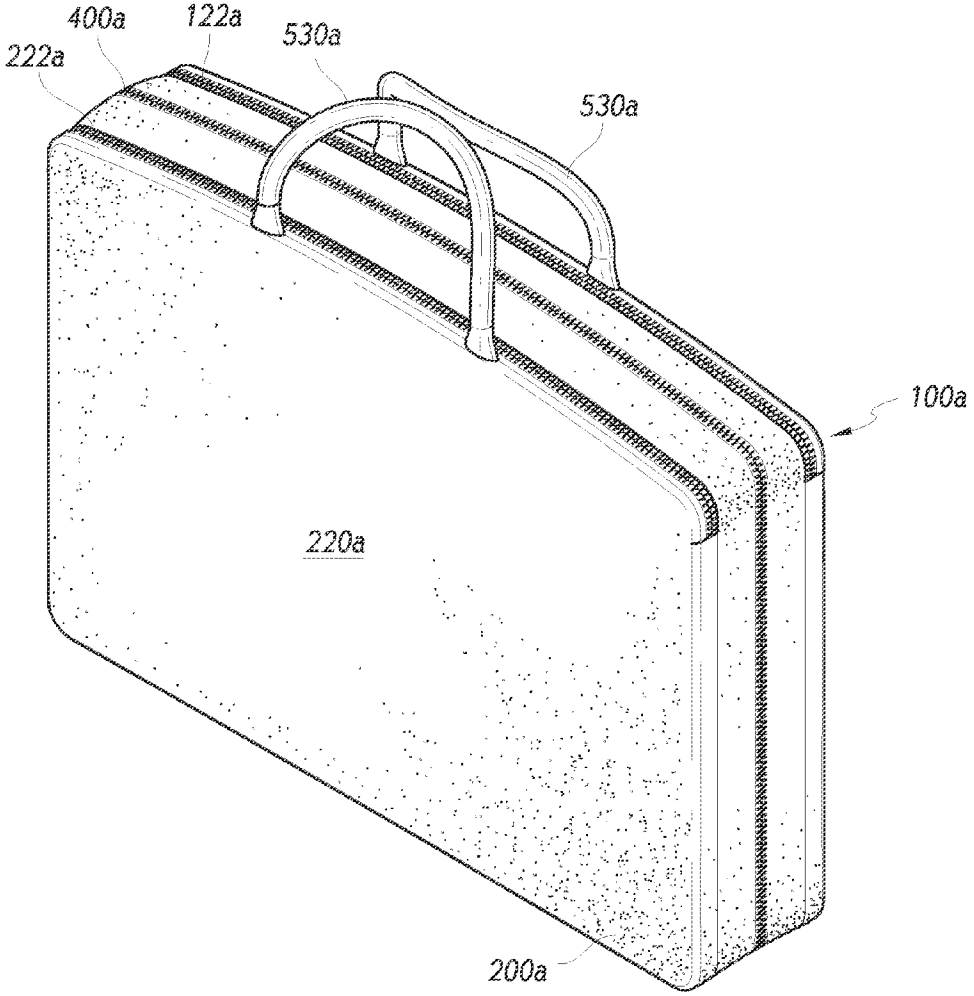
FIG. 14 is a front perspective view of the first exemplary convertible carrying case configured as a briefcase.
Figure 15:
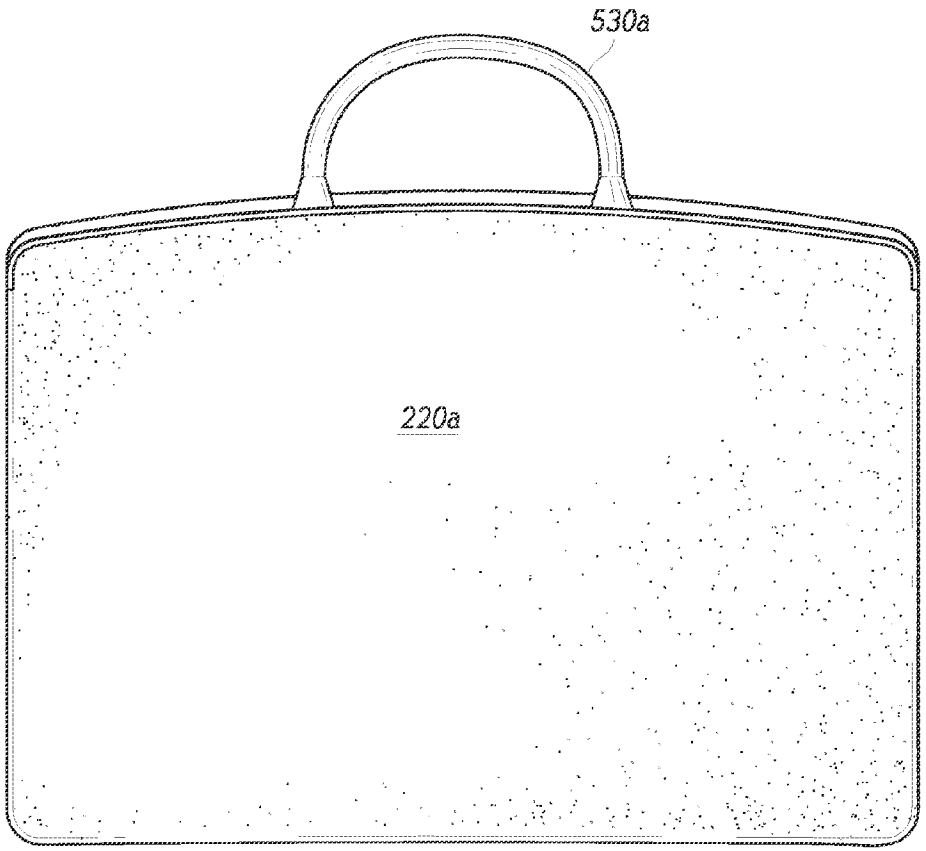
FIG. 15 is a front view of the first exemplary convertible carrying case configured as a briefcase.
Figure 16:
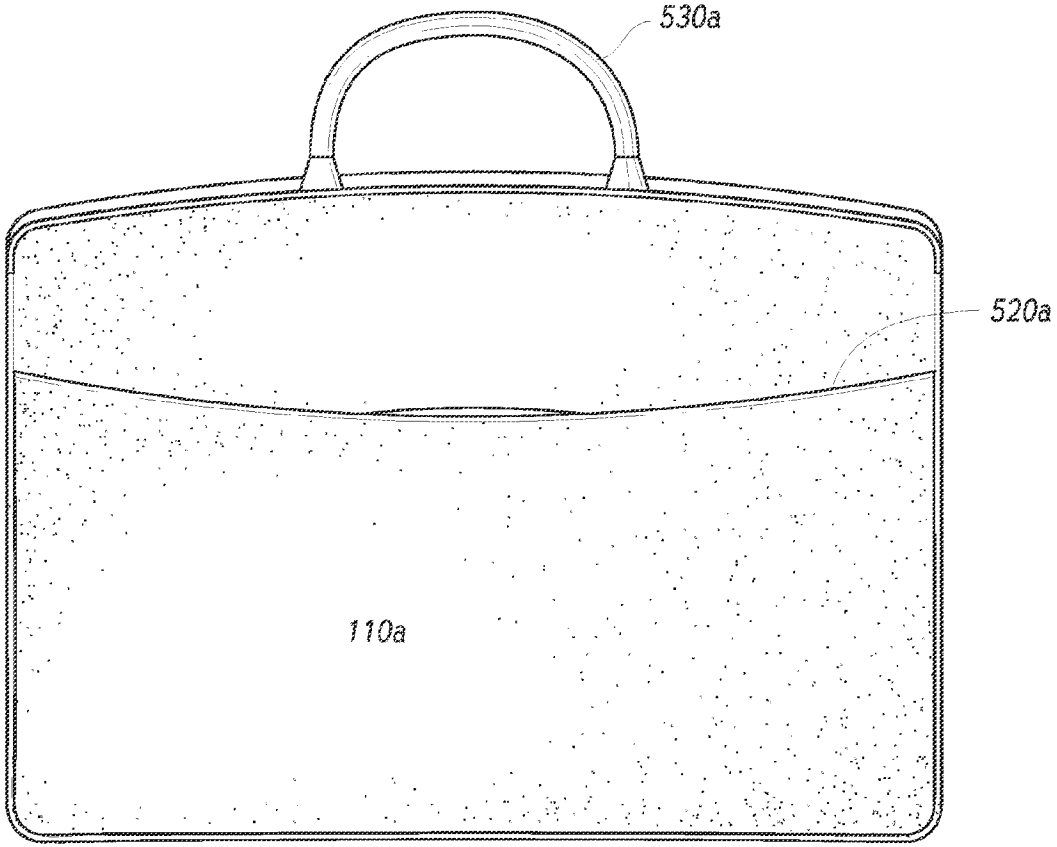
FIG. 16 is a rear view of the first exemplary convertible carrying case configured as a briefcase.
Figure 17:
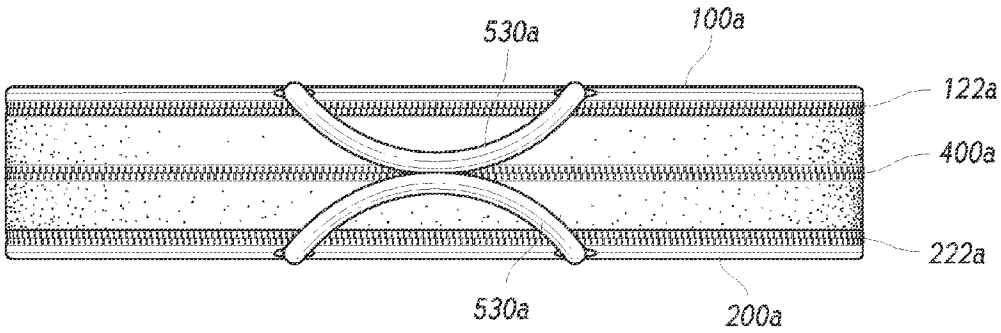
FIG. 17 is a top view of the first exemplary convertible carrying case configured as a briefcase.
Figure 18:
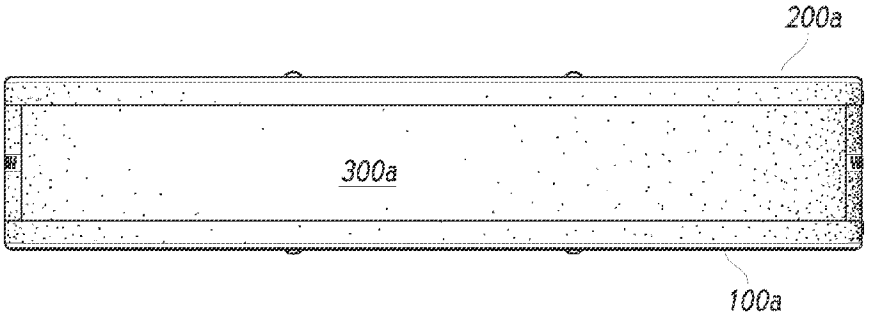
FIG. 18 is a bottom view of the first exemplary convertible carrying case configured as a briefcase.
Figure 20:
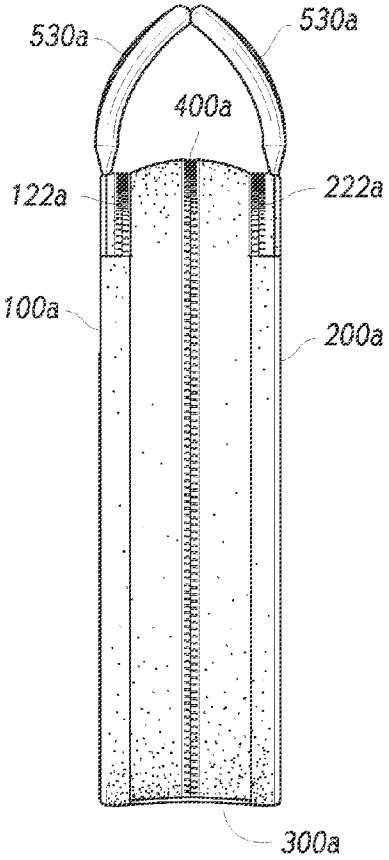
FIG. 20 is a second side view of the first exemplary convertible carrying case configured as a briefcase.
Figure 19:
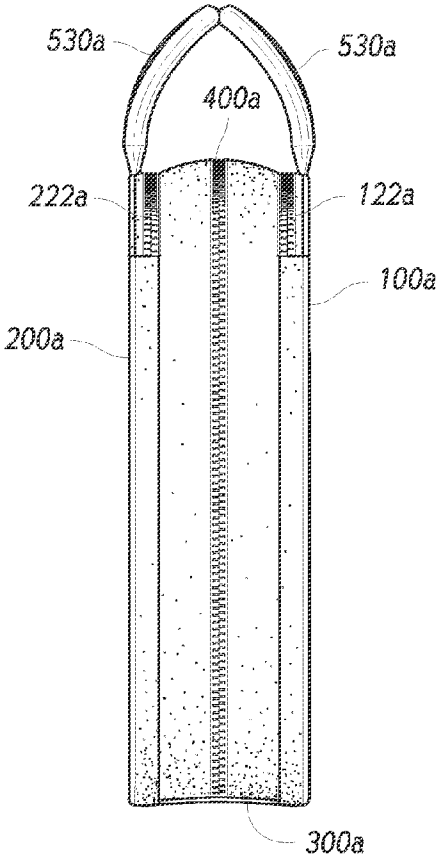
FIG. 19 is a first side view of the first exemplary convertible carrying case configured as a briefcase.
Figure 38:
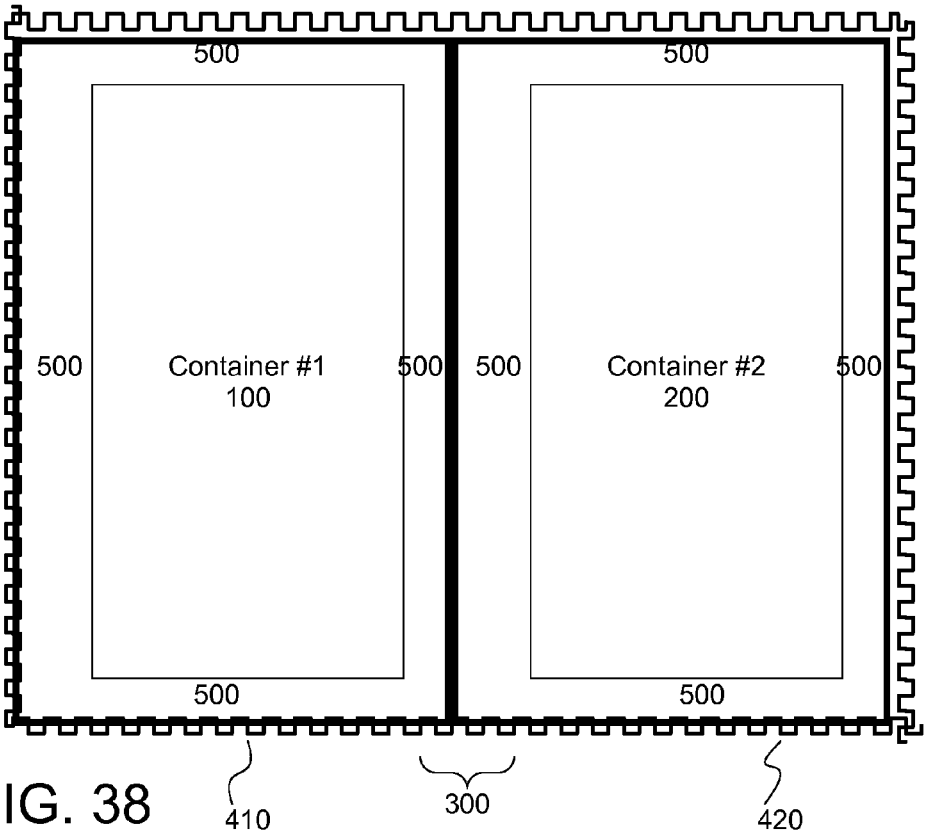
FIG. 38 is a simplified plan view of a simplified exemplary convertible carrying case, the periphery of each container having an annular extension, the annular extension along adjacent sides of the containers being attached together, the remaining sides of the annular extensions having openable-closeable connections associated therewith for use when the containers are aligned either in the configuration of FIG. 33 or the configuration of FIG. 37.
Figure 40:
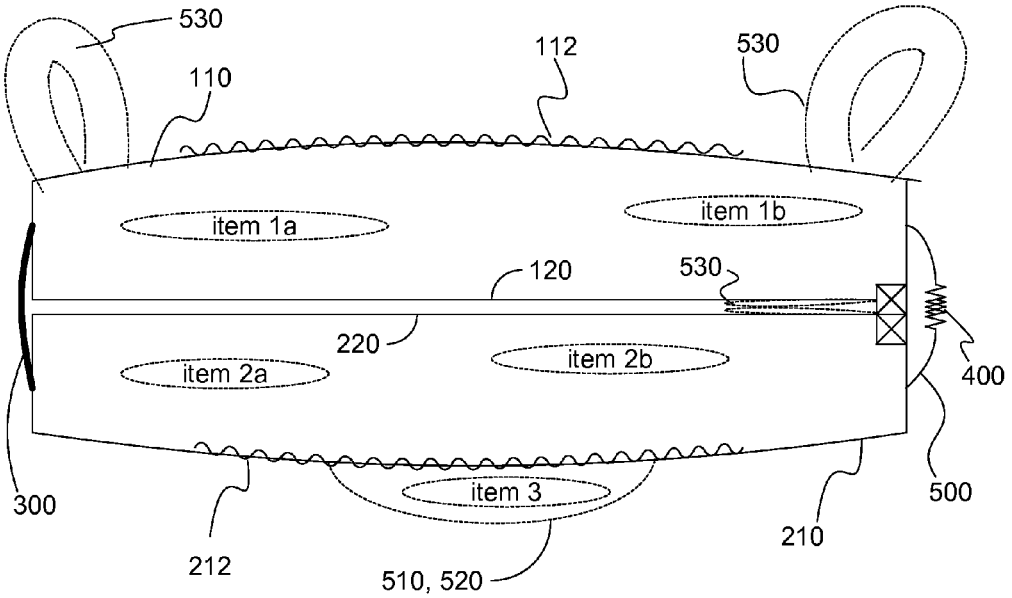
FIG. 40 is a simplified cross-sectional view of an exemplary convertible carrying case in a folded configuration, each container having one soft face and one hard/rigid face, with the hard/rigid face-being substantially coextensive and the soft face being external to the carrying case.
Figure 41:
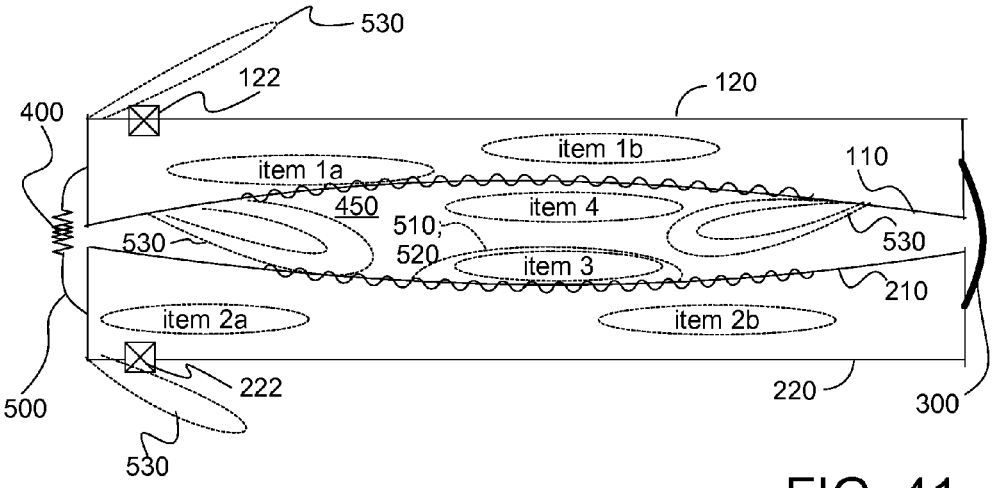
FIG. 41 is a simplified cross-sectional view of the exemplary convertible carrying case of FIG. 40 in a folded configuration with the soft being substantially coextensive and the hard/rigid faces being external to the carrying case.

The term "extension" or the phrase "annular extension" has to do with the structure that surrounds each of the containers 100, 200. The extension(s) 500 is/are associated with the hinge connections and openable-closeable connections. The direction of the extensions 500 "flips" between the faces such that the extensions 500 point towards the internal faces so that the associated connections span between the containers 100, 200. FIG. 38 shows an exaggerated annular extension 500. The hinge connection 300 is shown as being adjacent sides of the extensions 500 between the two containers 100, 200. The remaining sides of the extensions 500 each have an associated openable-closeable connection 400, 410, 420. The "flipping" is shown in FIG. 8. FIGS. 40 and 41 show how the extensions 500 and associated connections 300, 400, when in the closed position, span between the containers 100, 200. FIGS. 42-45 show the progression of the "flipping."

The phrase "accessory holders" is any structure into which additional items (accessories) can be attached or inserted. Exemplary accessory holders include, for example, pockets, pouches, hold down straps, clips, hoops, loops, snaps, hooks, and other known structure by which additional items may be attached or inserted in relation to the carrying case. Although shown in the figures, these accessory holders are optional. General and exemplary accessory holders are designated by reference numbers 510, 520, 510*a*, 510*b*, 520*a*, and 520*b*.

The phrase "carry structure" is structure that is associated with one or more containers that a user can use to carry or hold the carrying case. Exemplary carry structure includes handles, straps, grips, pulls, wheels, and any additional structure that a user could use to hold the carrying case. The carry structure may be specific for the specific type of carrying case the face is emulating. For example, if the outer faces are showing a briefcase, the carry structure might be handles on the outer face of each container. Another example would be if the outer faces are showing a backpack, the carry structure might be two straps on the outer face of one container.

General and exemplary carry structure are designated by reference numbers 530, 530*a*, and 530*b*.

The term "associated" is defined to mean integral or original, retrofitted, attached, or positioned near. As an example, as set forth herein, the extension(s) 500 is/are associated with the hinge connections and openable-closeable connections. The extensions 500 may be or may be integral with the hinge connection 300. The extensions 500 may be, may be integral with, or may be attached to the openable-closeable connection 400, 410, 420.

Unless specifically stated otherwise, the terms "first," "second," and "third" are meant solely for purposes of designation and not for order or limitation. Similarly, the terms "primary," "secondary," and "tertiary" are meant solely for purposes of designation and not for order or limitation. (For example, "primary configuration," "secondary configuration," and "tertiary configuration" have no specific order.) Still further, letters and numbers are used solely for purposes of designation and not for order or limitation. It should also be noted that use of numbers (e.g. #1 or #2) and the use of letters (e.g. A and B) are meant solely for purposes of designation and not for order or limitation. It should be noted that the designation of reference number is meant to assist in the comprehension of the drawings and is not meant to be limiting. For example in FIGS. 1-20, container 200*a* has associated backpack straps whereas in FIGS. 21-29, container 100*b* has associated backpack straps It should be noted that the term "front" is meant to be relative to the term "back" and the term "top" is meant to be relative to the term "bottom."

It should be noted that the terms "may," "might," "can," and "could" are used to indicate alternatives and optional features and only should be construed as a limitation if specifically included in the claims. It should be noted that the various components, features, steps, or embodiments thereof are all "preferred" whether or not it is specifically indicated. Claims not including a specific limitation should not be construed to include that limitation.

Unless specifically stated otherwise, the term "exemplary" is meant to indicate an example, representative, and/or illustration of a type. The term "exemplary" does not necessarily mean the best or most desired of the type. For example, "exemplary carry structure 530, 530*a*, and 530*b* may be handles, straps, grips, pulls" is just a set of examples of carry structure, but other carry structure could be just as desirable.

It should be noted that, unless otherwise specified, the term "or" is used in its nonexclusive form (e.g. "A or B" includes A, B, A and B, or any combination thereof, but it would not have to include all of these possibilities). It should be noted that, unless otherwise specified, "and/or" is used similarly (e.g. "A and/or B" includes A, B, A and B, or any combination thereof, but it would not have to include all of these possibilities). It should be noted that, unless otherwise specified, the terms "includes" and "has" mean "comprises" (e.g. a device that includes, has, or comprises A and B contains A and B, but optionally may contain C or additional components other than A and B). It should be noted that, unless otherwise specified, the singular forms "a," "an," and "the" refer to one or more than one, unless the context clearly dictates otherwise.

Convertible Carrying Case:

FIGS. 30-45 show the most basic of exemplary containers 100, 200 and exemplary relationships and structures associated therewith. FIGS. 1-20 show a more graphic first exemplary convertible carrying case that converts between a backpack configuration and a briefcase configuration. FIGS. 21-29 show a more graphic second exemplary convertible carrying case that converts between a backpack configuration, a briefcase configuration, and a saddlebag configuration. The discussion of the convertible carrying case associated with FIGS. 30-45, unless specifically stated otherwise, would be applicable to the convertible carrying cases associated with FIGS. 1-29. Similar reference numbers are used to ease in the understanding of the association except that reference numbers associated with FIGS. 1-20 are modified with a lowercase "a" and reference numbers associated with FIGS. 21-29 are modified with a lowercase "b."

Figure 30:
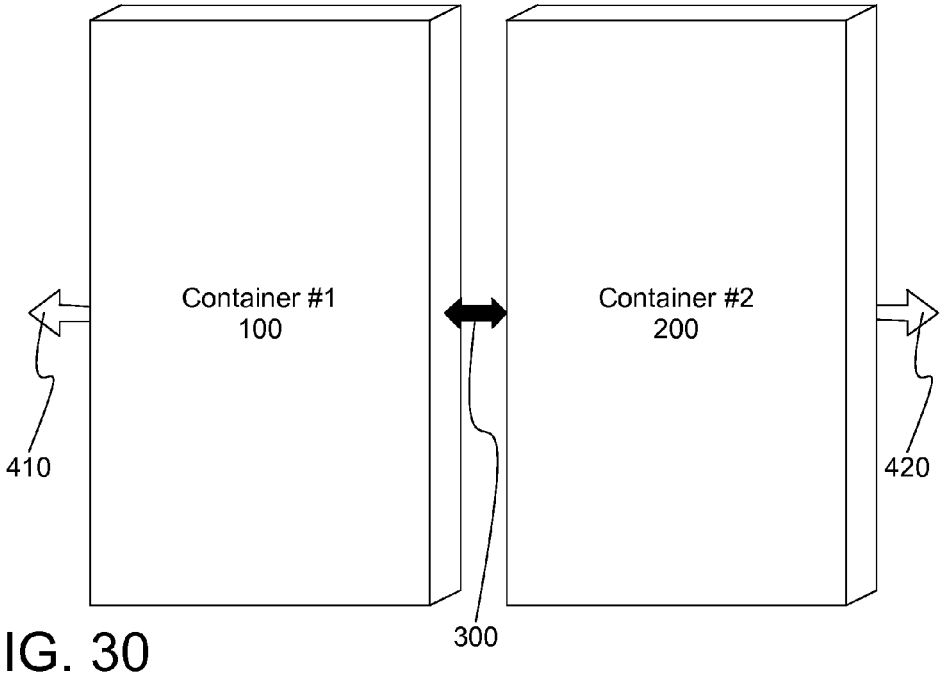
FIG. 30 is a simplified plan view of a simplified exemplary convertible carrying case, the double-sided solid black arrow between the two containers representing a hinge connection and the outlined arrows representing openable-closeable connections (the actual openable-closeable connections also being located on the top and bottom edges).

FIG. 30 shows two exemplary containers 100, 200 of an exemplary convertible carrying case. Each of the two containers 100, 200 of a preferred convertible carrying case has two faces, only one of which is visible in this figure. The double-sided solid black arrow between the two containers 100, 200 represents a hinge connection 300. The outlined arrows represent the matable halves 410, 420 of an openable-closeable connection 400. The actual openable-closeable connection 400 (and the respective halves 410, 420) also may be located on the top and bottom edges as shown in FIGS. 1-29.

Figure 31:
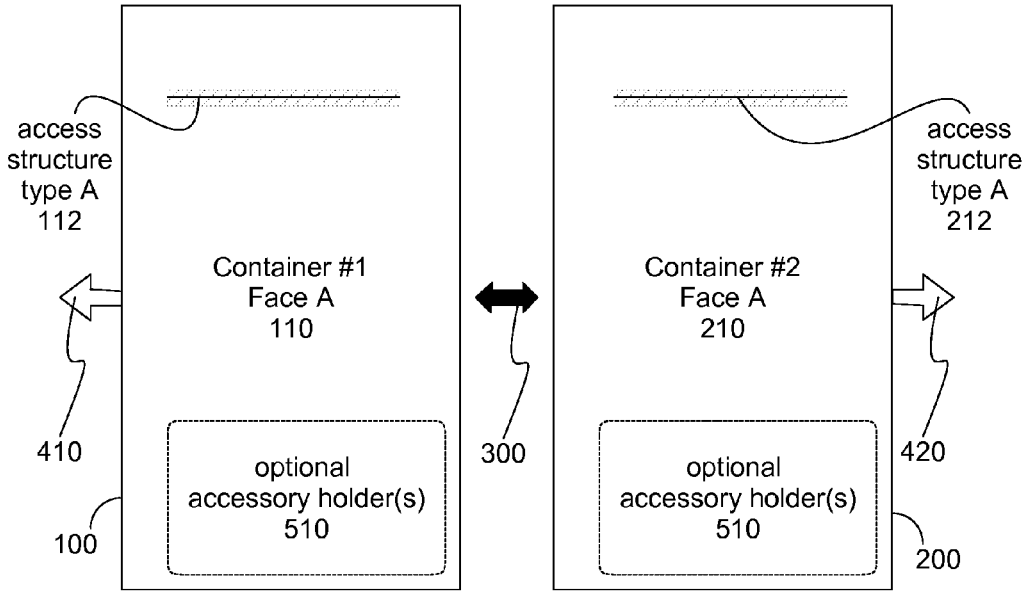
FIG. 31 is a simplified plan view of the exemplary convertible carrying case in an open, flattened position, each container showing its "A" face, each Face A having an access structure through which the contents of its respective container may be accessed.
Figure 32:
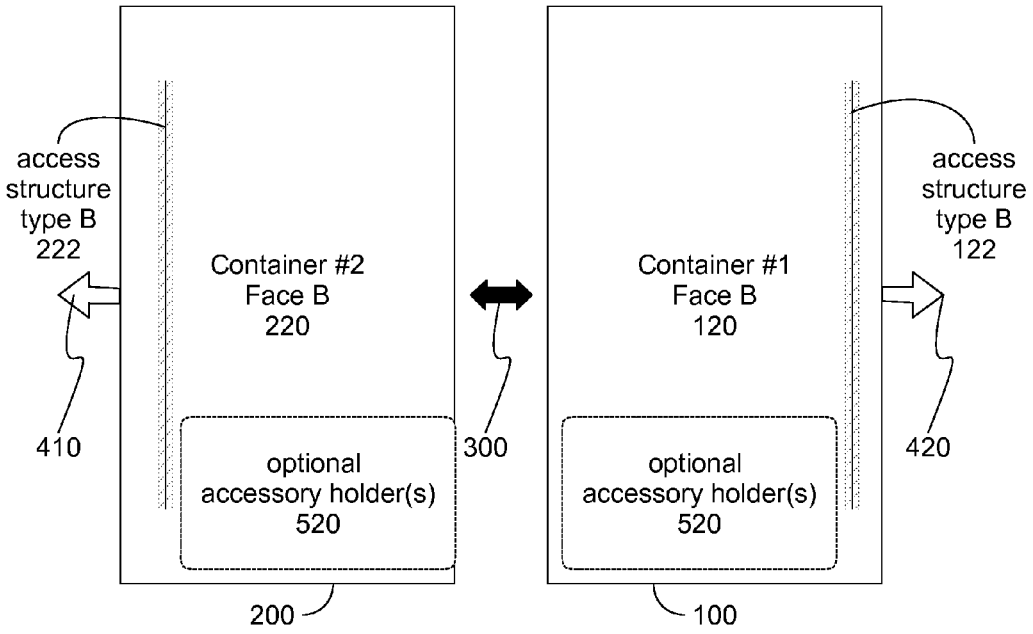
FIG. 32 is a simplified plan view of the exemplary convertible carrying case in the open, flattened position, each container showing its "B" face, each Face B having an access structure through which the contents of its respective container may be accessed.

FIGS. 31 and 32 show the exemplary convertible carrying case in an open, flattened position with the respective faces (Faces A 110, 210 for FIG. 31 and Faces B 120, 220 for FIG. 32) of the respective containers 100, 200 being shown. FIG. 32 is a view from the opposite side of FIG. 31. FIG. 35 is an end view of the same flattened position and may be helpful in understanding the views of FIGS. 31 and 32. Each face 110, 120, 210, 220 of each container 100, 200 has access structure 112, 122, 212, 222 that allows access into the interior of its respective container 100, 200. FIGS. 31 and 32 also show that each face 110, 120, 210, 220 may optionally have one or more associated holder(s) 510, 520. Omitted for simplicity in these figures (as well as FIGS. 33-38) is the carry structure 530 that may be associated with the faces 110, 120, 210, 220.

FIG. 31 shows the exemplary convertible carrying case in an open, flattened position with one face (Face A 110, 210) being shown. Each Face A 110, 210 has an access structure 112, 212 through which the contents of its respective container 100, 200 may be accessed. In this exemplary convertible carrying case, when Face A 110, 210 is the exterior surface, because the access structure 112, 212 is perpendicular to the longitudinal axis, the convertible carrying case would most likely be used in a vertical orientation (like a backpack) with the access structure 112, 212 positioned near the top of the convertible carrying case.

FIG. 32 shows the exemplary convertible carrying case in an open, flattened position with one face (Face B 120, 220) being shown. Each Face B 120, 220 has an access structure 122, 222 through which the contents of its respective container 110, 210 may be accessed. In this exemplary convertible carrying case, when Face B 120, 220 is the exterior surface, because the access structure 122, 222 is parallel to the longitudinal axis, the convertible carrying case would most likely be used in a horizontal orientation (like a briefcase) with the access structure 122, 222 positioned near the top of the convertible carrying case.

Figure 33:
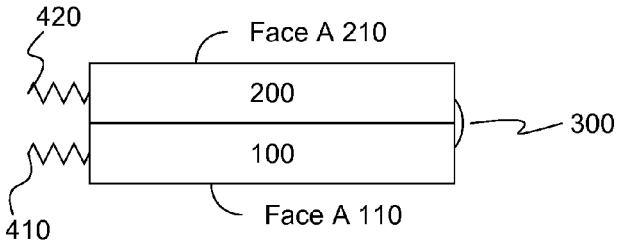
FIG. 33 is a simplified plan top view of the exemplary convertible carrying case in a first folded configuration with Face B of Container #1 being substantially coextensive with Face B of Container #2.

As set forth, FIGS. 1-20 show a first exemplary convertible carrying case that converts between a backpack configuration and a briefcase configuration and FIGS. 21-29 show second exemplary convertible carrying case that converts between a backpack configuration, a briefcase configuration, and a saddlebag configuration. The steps for converting between one configuration (shown graphically in FIGS. 1-7 and FIG. 29 as a backpack configuration) and another configuration (shown graphically in FIGS. 14-23 and FIGS. 21-23 as a briefcase configuration) are shown in their simplest form in FIGS. 33-37. The series of configuration conversion steps that make up the containers 100, 200 rotation about a longitudinal hinge connection 300 are as follows:

FIG. 33 shows the exemplary convertible carrying case in a first folded position with Face B (not labeled) of container 100 being substantially coextensive with Face B (not labeled) of container 200. Face A 110 and Face A 210 would be on the exterior of the convertible carrying case.

Figure 34:
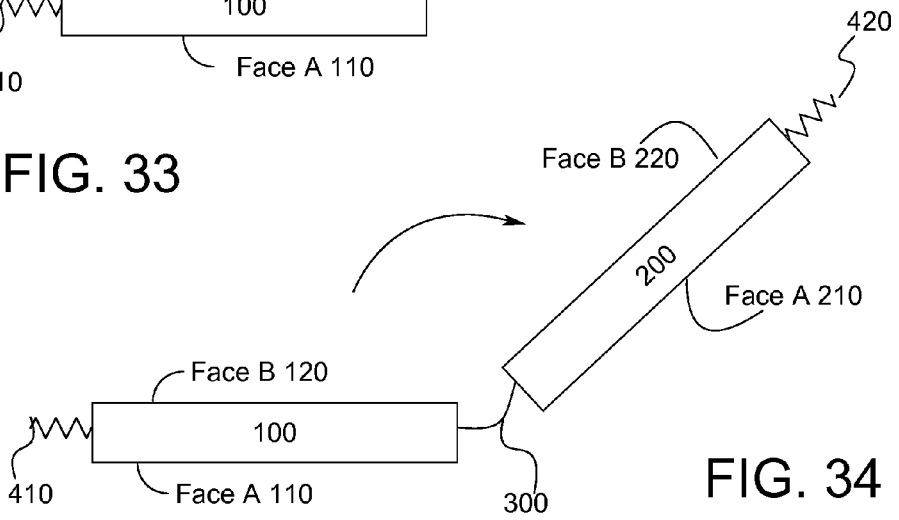
FIG. 34 is a simplified plan top view of the exemplary convertible carrying case in an intermediate position between the folded configuration of FIG. 33 and the flat configuration of FIG. 35.
Figure 35:
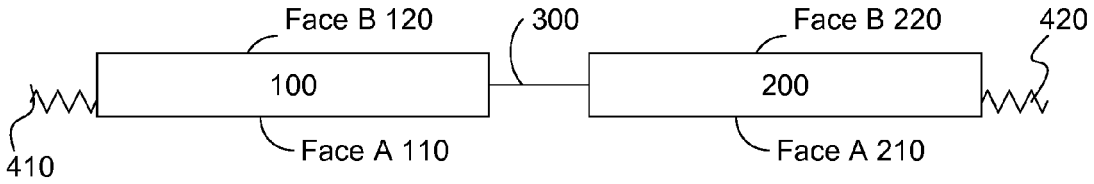
FIG. 35 is a simplified plan top view of the exemplary convertible carrying case in an open, flattened position, the relationship of the faces to their respective containers being shown.

FIG. 34 shows the exemplary convertible carrying case in an intermediate position between the folded position of FIG. 33 and the flat position of FIG. 35. In FIG. 34 the containers 100, 200 rotate apart about the longitudinal hinge connection 300.

FIG. 35 shows the exemplary convertible carrying case in an open, flattened position, the relationship of the faces 110, 120, 210, 220 to their respective containers 100, 200 being shown.

Figure 36:
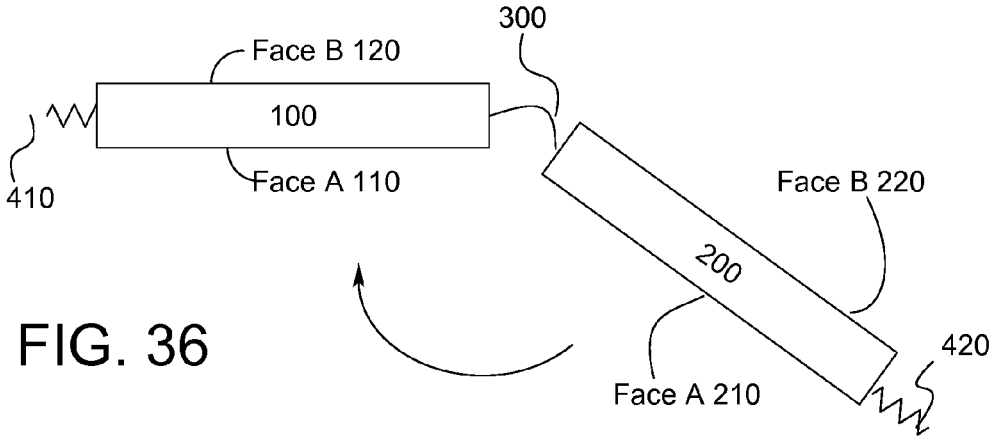
FIG. 36 is a simplified plan top view of the exemplary convertible carrying case in an intermediate position between the flat configuration of FIG. 35 and the folded configuration of FIG. 37.
Figure 37:
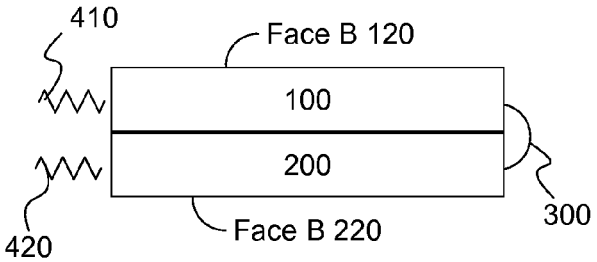
FIG. 37 is a simplified plan top view of the exemplary convertible carrying case in a first folded configuration with Face A of Container #1 being substantially coextensive with Face A of Container #2.

FIG. 36 shows the exemplary convertible carrying case in an intermediate position between the flat position of FIG. 35 and the folded position of FIG. 37. In FIG. 36 the containers 100, 200 rotate towards each other about the longitudinal hinge connection 300.

FIG. 37 shows the exemplary convertible carrying case in a second folded position with Face A (not labeled) of container 100 being substantially coextensive with Face A (not labeled) of container 200. Face B 120 and Face B 220 would be on the exterior of the convertible carrying case.

It should be noted that the "rotation" and "rotating" of the containers 100, 200 about the longitudinal hinge connection 300 is meant to be relative. The rotation may actually be only one container 100, 200 while the other container 100, 200 remains stationary.

Figure 42:
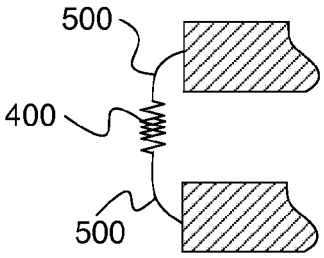
FIG. 42 is a simplified cross-sectional side view showing two extensions at the edges of respective containers, each extension having an associated matable half, the matable halves forming an openable-closeable connection that spans between the containers.
Figure 43:
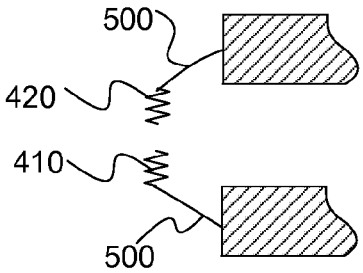
FIG. 43 is a simplified cross-sectional side view showing the extensions and matable halves of FIG. 42, the matable halves separated so that they no longer form an openable-closeable connection, and the extensions and associated matable halves beginning the process of "flipping."
Figure 44:
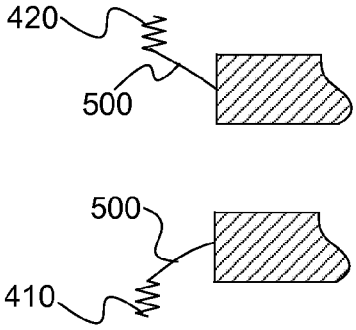
FIG. 44 is a simplified cross-sectional side view showing the extensions and matable halves of FIG. 42, and the extensions and associated matable halves continuing the process of "flipping."
Figure 45:
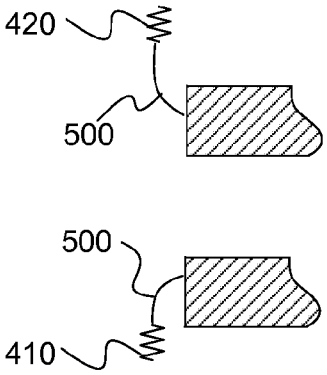
FIG. 45 is a simplified cross-sectional side view showing the extensions and matable halves of FIG. 42, and the extensions and associated matable halves finishing the process of "flipping" so that after the containers rotate about the longitudinal hinge connection (not shown), the extensions and associated matable halves will point towards the internal faces so that the associated connections span between the containers in the new position.

FIG. 38 shows the containers 100, 200 of the convertible carrying case having an annular extension 500. The annular extension 500 along adjacent sides of the containers 100, 200 (one side of each container 100, 200) are associated (e.g. attached or integral) so as to form the hinge connection 300. The remaining sides of the annular extensions 500 have openable-closeable connections 400 associated therewith for use when the containers 100, 200 are aligned either in the configuration of FIG. 33 or the configuration of FIG. 37. FIGS. 33, 37, and 40-45 show the matable halves 410, 420 (FIGS. 33 and 37) and the extensions 500 (FIGS. 40 and 41) with container ends associated with the edge of the container 100, 200 and "free" ends with the matable halves 410, 420 that can be joined to form the openable-closeable connections 400. As shown in FIG. 42, the free ends bend towards or "point" towards each other so that when they are joined they span the gap (or compartment) between the containers 100, 200. FIGS. 43-45 show the progression of the extensions 500 and matable halves 410, 420 as they "flip." The flexibility of the extensions 500 allow the bending or pointing to be performed repeatedly to secure the containers 100, 200 in the various configurations. Before, after, or during the steps associated with the containers 100, 200 rotating about a longitudinal hinge connection 300, the direction of the extensions 500 "flips" between the faces 110, 120, 210, 220 such that the extensions 500 point towards the internal faces so that the associated connections span between the containers 100, 200. The beginning of exemplary "flipping" is shown graphically in FIG. 8 and the completion of the exemplary "flipping" is shown graphically in FIG. 9. In the FIG. 8-9 example, the "flipping" occurs prior to or at the beginning of the rotation about a longitudinal hinge connection 300. The "flipping," however, can be performed at other stages of the conversion. FIGS. 40-42 show how the extensions 500 and associated connections 300, 400, when in the closed position, span between the containers 100, 200.

Figure 39:
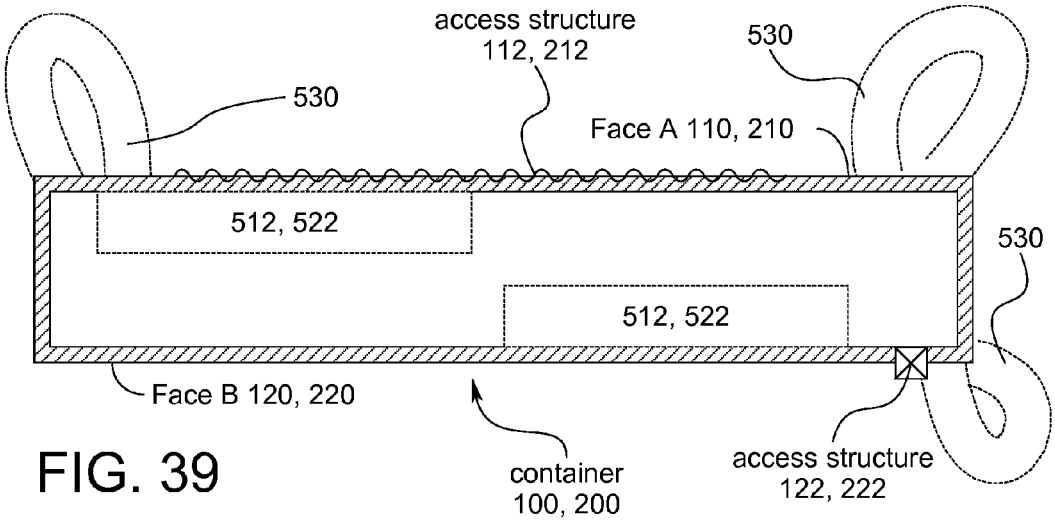
FIG. 39 is a simplified cross-sectional view of a simplified exemplary container showing access structure in both faces and optional accessory holder(s) on its interior surfaces.

FIG. 39 is a simplified cross-sectional view of a simplified exemplary container 100, 200 showing access structure 112, 122, 212, 222 in both faces 100, 200 and optional accessory holder(s) 512, 522 on its interior surfaces.

FIGS. 40 and 41 show a simplified exemplary convertible carrying case with two containers 100, 200 each having one soft face 110, 210 and one hard/rigid face 120, 220. FIG. 40 shows the convertible carrying case in a folded position (similar to FIG. 33 or 37) with the hard/rigid faces 120, 220 being substantially coextensive and the soft faces 110, 210 being external to the carrying case. FIG. 41 shows the carrying case in a folded position (similar to FIG. 33 or 37) with the soft faces 110, 210 being substantially coextensive and the hard/rigid faces 120, 220 being external to the carrying case. These figures also show exemplary items in each container 100, 200. The containers 100, 200 are accessible through the access structure 112, 122, 212, 222 on the outer faces 110, 120, 210, 220 of the containers 100, 200. The containers 100, 200 also are shown with exemplary carry structure (in phantom). FIG. 41 also shows that additional items (item 4) can be stored in a compartment 450 between the two containers 100, 200 (and surrounded and enclosed by the annular extension 500).

Saddlebag Configuration:

FIGS. 21-29 show the second exemplary convertible carrying case that not only converts between a backpack configuration and a briefcase configuration, but has an additional saddlebag configuration to which it can also be converted. FIGS. 21-23 show an exemplary briefcase configuration. FIG. 29 shows an exemplary backpack configuration. The second exemplary convertible carrying case differs from the first exemplary convertible carrying case in three related aspects. The first and most obvious distinction is the presence of the spanning yoke **320*b* (shown in an intermediary position in FIGS. 24, 25, and 27, in the fully extended position in FIG. 26, and in the secured position in FIGS. 28 and 29). The second distinction is that the hinge connection 300*b* is associated with the spanning yoke 320*b* (best seen in FIGS. 24-27) and the hinge connection 300*b* can be "opened" and "closed" (by unzipping and zipping the two matable halves 332*b*, 334*b* of the "hinge" spanning yoke openable-closeable connection 330*b*). The third distinction is that the spanning yoke 320*b* is preferably (although not mandatorily) securable to the face 201*b* of the container 200*b* (best seen secured in FIGS. 28-29) by, for example, "opening" (unzipping) and "closing" (zipping) two matable halves 342*b*, 344*b* of the "flap" spanning yoke openable-closeable connection 340*b*. Opening or disconnecting the two matable halves 332*b*, 334*b* of the "hinge" spanning yoke openable-closeable connection 330*b* and opening or disconnecting the two matable halves 342*b*, 344*b* of the "flap" spanning yoke openable-closeable connection 340*b* frees the spanning yoke 320***b* so that the convertible carrying case can expand into the saddlebag configuration.

The conversion between the briefcase configuration and the backpack configuration is similar to the conversion of the first exemplary convertible carrying case (FIGS. 1-20). For the conversion between the briefcase configuration and the backpack configuration, the spanning yoke 320*b* would be secured against the face 210*b* of the container 200*b*. The hinge connection 300*b* would be "closed" with the two matable halves 332*b*, 334*b* mated. The openable-closeable connection 400*b* would be "opened" (separating the half 410*b* from the half 420*b* by, for example, unzipping). The containers 100*b*, 200*b* would then rotate apart about the longitudinal hinge connection 300*b* as shown, for example, in FIG. 28. Before, after, or during the steps associated with the containers 100*b*, 200*b* rotating about the longitudinal hinge connection 300*b*, the direction of the extensions 500*b* "flips" between the faces 110*b*, 120*b*, 210*b*, 220*b* such that the extensions 500*b* point towards the internal faces so that the associated connections span between the containers 100*b*, 200*b*. The openable-closeable connection 400*b* would be "closed" (bringing together the half 410*b* and the half 420*b* by, for example, zipping).

FIGS. 24-25 show an exemplary conversion between the briefcase configuration and the saddlebag configuration and FIG. 26 shows an exemplary saddlebag configuration with the spanning yoke 320*b* fully extended. For this conversion, the matable halves of the openable-closeable connections are opened or disconnected as follows: the two matable halves 410*b*, 420*b* of the openable-closeable connection 400*b* are opened or disconnected; the two matable halves 332*b*, 334*b* of the "hinge" spanning yoke openable-closeable connection 330*b* are opened or disconnected; and the two matable halves 342*b*, 344*b* of the "flap" spanning yoke openable-closeable connection 340*b* are opened or disconnected. This opening or disconnecting may be done in conjunction with the separating (distancing or pulling apart) of the two containers 100*b*, 200*b*. In the saddlebag configuration the interior of the containers 100*b*, 200*b* are accessible through the respective access structure 122*b*, 222*b*.

To return to either the backpack or the briefcase configurations, the two matable halves 332*b*, 334*b* of the "hinge" spanning yoke openable-closeable connection 330*b* are closed or connected and the two matable halves 342*b*, 344*b* of the "flap" spanning yoke openable-closeable connection 340*b* are closed or connected. FIG. 27 shows attachment guide lines representing how the spanning yoke 320*b* could be re-secured. This return to the backpack or the briefcase configurations may be done in conjunction with the bringing together and/or rotation of the two containers 100*b*, 200*b*.

Distinctions from Known Convertible Carrying Cases:

U.S. Published Application No. 2003/0042277 to Gulmatico, U.S. Pat. No. 4,236,657 to Brunton, U.S. Pat. No. 2,493,506 to Schwartbard, U.S. Pat. No. 2,010,166 to Thompson, and the Tumi Dror reference were discussed in the Background. These references are discussed as examples of prior art. The convertible carrying cases disclosed herein have both physical distinctions and functional distinctions. For the purpose of illustrating exemplary distinctions, these references are being discussed and distinguished. It should be noted that not all the distinctions for each reference are being provided for each reference.

The convertible carrying cases disclosed herein have both a first and a second container. Each container has a primary face and a secondary face that at least partially surrounds an interior of the respective container. Each face has its own respective access structure for accessing the interior of the respective container. When the primary faces are on the exterior of the convertible carrying case (the primary configuration), the interior of the first container is accessible through the access structure of its primary face and the interior of the second container is accessible through the access structure of its primary face. When the secondary faces are on the exterior of the convertible carrying case (the secondary configuration), the interior of the first container is accessible through the access structure of its secondary face and the interior of the second container is accessible through the access structure of its secondary face. The use of annular extensions surrounding the containers (the extensions "flipping" during conversion between configurations) allows the creation of an additional compartment between the two containers. The conversion between the primary configuration and secondary configuration may be made by, for example, rotating the containers about a longitudinal hinge connection. The process of conversion does not necessitate the removal or rearrangement of the contents of the containers and the contents remain accessible in either configuration.

Among the distinctions between the convertible carrying case disclosed herein and the convertible carrying case disclosed in U.S. Published Application No. 2003/0042277 to Gulmatico is the fact that the harness pouch and the main elongated bag share a common face or panel. This makes it impossible for Gulmatico "containers" to rotate about a longitudinal hinge connection. The common face or panel also does not have any access structure.

Among the distinctions between the convertible carrying case disclosed herein and the convertible carrying case disclosed in U.S. Pat. No. 4,236,657 to Brunton, is the absence in the Brunton convertible carrying case of access structure associated with each "face" of the Brunton "containers." Further, because one container effectively wraps around the other container, the containers do not appear to be accessible in all configurations.

Among the distinctions between the convertible carrying case disclosed herein and the convertible carrying case disclosed in U.S. Pat. No. 2,493,506 to Schwartbard, is the absence in the Schwartbard convertible carrying case of access structure associated with each "face" of the Schwartbard "containers" (handbag portions). Schwartbard specifically discloses that each handbag portion has a single opening that remains "on top" so that it is accessible in either configuration. This is significant because it limits the types of containers and configurations that could be used. For example, since the single opening would have to be on the top, both configurations would have to be oriented horizontally or both configurations would have to be oriented vertically. There could not be one configuration oriented vertically and one configuration oriented horizontally.

In the broadest sense, the distinctions between the convertible carrying case disclosed herein and the convertible carrying case disclosed in U.S. Pat. No. 2,010,166 to Thompson are similar to those discussed in relation to the Schwartbard reference. Theoretically, after the hood member has been removed, the Thompson golf bag can be inverted to carry with the golf club pockets on the inside or the outside. It does not seem particularly practical to carry golf clubs in the golf club pockets on the inside except when it is being stored with the hood member. The golf club pockets have a single opening through which the golf clubs may be inserted or removed regardless of the configuration of the golf bag.

The "brief" in the Tumi Dror Benshetrit line is "two cases in one" in that it transforms from a slim portfolio to a medium capacity brief. This transformation is accomplished by unzipping and inverting two "sides" to change shape and functionality. The "brief" has two "sides." The two "sides" rotate around a hinge connection to change configurations. The sides appear to have at least some pockets or pouches associated therewith. Each pocket or pouch, however, only has one opening or access structure. Accordingly, when the "brief" is in the slim portfolio configuration, the pockets on the inside can only be accessed by at least partially separating the "sides" and accessing the pockets therethrough. Similarly, when the "brief" is in the medium capacity brief configuration, the pockets on the inside can only be accessed by at least partially separating the "sides" and accessing the pockets therethrough. There are no pockets or other structure that could be equivalent to the containers of the convertible carrying case disclosed herein that have multiple access structures and thus are accessible in multiple configurations.

Miscellaneous:

It is to be understood that the inventions, examples, and embodiments described herein are not limited to particularly exemplified materials, methods, and/or structures. It is to be understood that the inventions, examples, and embodiments described herein are to be considered preferred inventions, examples, and embodiments whether specifically identified as such or not.

All references (including, but not limited to, foreign and/or domestic publications, patents, and patent applications) cited herein, whether supra or infra, are hereby incorporated by reference in their entirety.

The terms and expressions that have been employed in the foregoing specification are used as terms of description and not of limitation, and are not intended to exclude equivalents of the features shown and described. While the above is a complete description of selected embodiments of the present invention, it is possible to practice the invention using various alternatives, modifications, adaptations, variations, and/or combinations and their equivalents. It will be appreciated by those of ordinary skill in the art that any arrangement that is calculated to achieve the same purpose may be substituted for the specific embodiment shown. It is also to be understood that the following paragraph is intended to cover all of the generic and specific features of the invention herein described and all statements of the scope of the invention which, as a matter of language, might be said to fall therebetween.

What is claimed is:

1. A convertible carrying case having a first container and a second container, comprising:

(a) said first container having a primary face and a secondary face, said primary face and said secondary face at least partially surrounding an interior of said first container, said primary face having a primary access structure for accessing said interior of said first container, said secondary face having a secondary access structure for accessing said interior of said first container;

(b) said second container having a primary face and a secondary face, said primary face and said secondary face at least partially surrounding an interior of said second container, said primary face having a primary access structure for accessing said interior of said second container, said secondary face having a secondary access structure for accessing said interior of said second container; and (c) a hinge connection between said first container and said second container, said hinge connection facilitating conversion between a primary configuration and a secondary configuration, said primary configuration having said primary faces facing outward while said secondary faces are adjacent to each other, and said secondary configuration having said secondary faces facing outward while said primary faces are adjacent to each other.

2. The convertible carrying case of claim 1, wherein contents within the containers may remain during conversion between said primary configuration and said secondary configuration.

3. The convertible carrying case of claim 1, wherein said interiors of said containers are accessible through respective primary access structure in respective primary faces when said convertible carrying case is in said primary configuration, and wherein said interiors of said containers are accessible through respective secondary access structure in respective secondary faces when said convertible carrying case is in said secondary configuration.

4. The convertible carrying case of claim 1, said primary configuration emulating a first type of carrying case and said secondary configuration emulating a secondary type of carrying case.

5. The convertible carrying case of claim 1, said primary configuration emulating a first type of carrying case having a first orientation and said secondary configuration emulating a secondary type of carrying case having a secondary orientation, the first orientation being horizontal and the second orientation being vertical.

6. The convertible carrying case of claim 1, at least one of said configurations having a compartment defined between said first container and said second container.

7. The convertible carrying case of claim 1, wherein said configurations are a backpack configuration and a briefcase configuration.

8. The convertible carrying case of claim 1, further including a tertiary configuration, said configurations being a backpack configuration, a briefcase configuration, and a saddlebag configuration.

9. The convertible carrying case of claim 1, each container having an annular extension, at least part of each of said annular extensions associated with said hinge connection.

10. A convertible carrying case having a first container and a second container, comprising:

(a) said first container having a primary face and a secondary face, said primary face and said secondary face at least partially surrounding an interior of said first container, said primary face having a primary access structure for accessing said interior of said first container, said secondary face having a secondary access structure for accessing said interior of said first container;

(b) said second container having a primary face and a secondary face, said primary face and said secondary face at least partially surrounding an interior of said second container, said primary face having a primary access structure for accessing said interior of said second container, said secondary face having a secondary access structure for accessing said interior of said second container; and (c) a hinge connection between said first container and said second container, said hinge connection facilitating conversion between a primary configuration and a secondary configuration, said primary configuration having said primary faces facing outward while said secondary faces are adjacent to each other, and said secondary configuration having said secondary faces facing outward while said primary faces are adjacent to each other;

(d) wherein said interiors of said containers are accessible through respective primary access structure in respective primary faces when said convertible carrying case is in said primary configuration, and wherein said interiors of said containers are accessible through respective secondary access structure in respective secondary faces when said convertible carrying case is in said secondary configuration.

11. The convertible carrying case of claim 10, wherein contents within the containers may remain during conversion between said primary configuration and said secondary configuration.

12. The convertible carrying case of claim 10, said primary configuration emulating a first type of carrying case and said secondary configuration emulating a secondary type of carrying case.

13. The convertible carrying case of claim 10, said primary configuration emulating a first type of carrying case having a first orientation and said secondary configuration emulating a secondary type of carrying case having a secondary orientation, the first orientation being horizontal and the second orientation being vertical.

14. The convertible carrying case of claim 10, at least one of said configurations having a compartment defined between said first container and said second container.

15. The convertible carrying case of claim 10, wherein said configurations are a backpack configuration and a briefcase configuration.

16. The convertible carrying case of claim 10, further including a tertiary configuration, said configurations being a backpack configuration, a briefcase configuration, and a saddlebag configuration.

17. The convertible carrying case of claim 10, each container having an annular extension, at least part of each of said annular extensions associated with said hinge connection.

18. A method for converting a convertible carrying case between a primary configuration and a secondary configuration, said method comprising the steps of:

(a) providing a first container having a primary face and a secondary face, said primary face and said secondary face at least partially surrounding an interior of said first container, said primary face having a primary access structure for accessing said interior of said first container, said secondary face having a secondary access structure for accessing said interior of said first container;

(b) providing a second container having a primary face and a secondary face, said primary face and said secondary face at least partially surrounding an interior of said second container, said primary face having a primary access structure for accessing said interior of said second container, said secondary face having a secondary access structure for accessing said interior of said second container; and (c) rotating at least one of said first and second containers about a longitudinal hinge connection, the hinge connection between said first container and said second container, said rotating converting said convertible carrying case in said primary configuration with said primary faces facing outward while said secondary faces are adjacent to each other to said secondary configuration with said secondary faces facing outward while said primary faces are adjacent to each other;

(d) wherein said containers are accessible through said primary access structure when said convertible carrying case is in said primary configuration and accessible through said secondary access structure when said convertible carrying case is in said secondary configuration.

* * * * *